US010052264B2

(12) United States Patent
McClintock et al.

(10) Patent No.: US 10,052,264 B2
(45) **Date of Patent: *Aug. 21, 2018**

(54) TOY WITH MULTI-CONNECTOR FOR DIFFERENT STYLES OF SOOTHING DEVICES

(71) Applicant: KIDS II, INC., Atlanta, GA (US)

(72) Inventors: Christopher McClintock, Watkinsville, GA (US); Brittany Elson, Atlanta, GA (US); Bradford Reese, Decatur, GA (US)

(73) Assignee: KIDS II, INC., Atlanta, GA (US)

( * ) Notice: Subject to any disclaimer, the term of this patent is extended or adjusted under 35 U.S.C. 154(b) by 115 days.

This patent is subject to a terminal disclaimer.

(21) Appl. No.: 15/077,577

(22) Filed: Mar. 22, 2016

(65) Prior Publication Data

US 2016/0199264 A1 Jul. 14, 2016

Related U.S. Application Data

(63) Continuation-in-part of application No. 14/173,933, filed on Feb. 6, 2014, now Pat. No. 9,320,975.

(60) Provisional application No. 61/763,680, filed on Feb. 12, 2013, provisional application No. 61/761,277, filed on Feb. 6, 2013.

(51) Int. Cl.

| | |
|---|---|
| ***A63H 3/00*** | (2006.01) |
| ***A61J 17/00*** | (2006.01) |
| ***A63J 17/00*** | (2006.01) |

(52) U.S. Cl.

CPC ..... *A61J 17/007* (2015.05); *A63H 3/003* (2013.01); *A63J 17/00* (2013.01)

(58) Field of Classification Search

CPC ..... A63H 3/00
USPC ..... 446/73
See application file for complete search history.

(56) References Cited

U.S. PATENT DOCUMENTS

| | | | |
|---|---|---|---|
| 1,279,615 | A | 9/1918 | Van Meter |
| 3,392,729 | A | 7/1968 | Lenoir |
| 4,188,747 | A | 2/1980 | Kramer |
| 4,204,362 | A | 5/1980 | Fournier |
| 4,277,910 | A | 7/1981 | Kramer |
| D278,920 | S | 5/1985 | Wichman |
| 4,852,569 | A | 8/1989 | Sanders |
| 4,985,968 | A | 1/1991 | Hooper |

(Continued)

FOREIGN PATENT DOCUMENTS

EP 1847307 A1 10/2007

*Primary Examiner* — John E Simms, Jr.
*Assistant Examiner* — Dolores Collins
(74) *Attorney, Agent, or Firm* — Gardner Groff Greenwald & Villanueva, PC

(57) ABSTRACT

A toy includes a multi-connector for removable attachment to a variety of different styles of soothing devices such as pacifiers. The multi-connector includes one or more transverse tabs configured for individually or collectively releasably attaching to each of the different coupling part styles of the smoothing devices. In this way, the toy can be used with any of the different styles of soothing devices and still be safe because the axial pulling motion and forces that babies often apply to the toy when holding the pacifier in its mouth do not cause the components to separate. Also disclosed is a toy with a tab (transverse or not) that is retained on the toy by a primary attachment such as stitching and a secondary retainer for redundancy as a safety feature.

14 Claims, 24 Drawing Sheets

(56) References Cited

U.S. PATENT DOCUMENTS 5,344,355 A * 9/1994 Silverstein ..... A63H 3/003 446/268
5,534,014 A 7/1996 Demeritt et al.
5,593,336 A * 1/1997 Thomas ..... A63H 33/00 446/419
5,607,452 A 3/1997 Michaud
5,660,301 A 8/1997 Kaplowitz
D393,074 S 3/1998 Fields et al.
D409,755 S 5/1999 Thorpe et al.
D413,675 S 9/1999 Thorpe et al.
6,066,162 A 5/2000 Hudson
6,221,093 B1 4/2001 Prince
D443,065 S 5/2001 Byes et al.
6,299,501 B1 10/2001 Lynch
6,461,214 B1 10/2002 Lynch
6,634,919 B2 10/2003 Gordon et al.
6,666,720 B1 12/2003 Reisinger et al.
6,666,740 B1 12/2003 Schneider
6,684,422 B2 2/2004 LeFevre et al.
6,810,545 B1 11/2004 Darling et al.
D500,817 S 1/2005 Forte
D519,581 S 4/2006 Velez et al.
7,086,121 B2 8/2006 Lippincott
7,219,456 B1 * 5/2007 Wei ..... F24C 7/004 392/348
D609,284 S 2/2010 Markland et al.
7,770,312 B2 * 8/2010 Stinson ..... F24C 7/004 40/428
D625,369 S 10/2010 Raimondi
7,874,679 B2 * 1/2011 Stonier ..... H04N 5/7408 353/10
D633,576 S 3/2011 Dalton et al.
D633,577 S 3/2011 Dalton et al.
D643,074 S 8/2011 Dalton et al.
D650,868 S 12/2011 Dalton et al.
8,156,616 B2 4/2012 Lo
8,636,768 B2 1/2014 Rohrig
8,864,547 B2 10/2014 Elson et al.
D717,454 S 11/2014 Reese
9,016,644 B2 4/2015 Reese
9,272,225 B2 * 3/2016 Gunter ..... A63H 33/22
9,320,975 B2 * 4/2016 McClintock ..... A63H 3/003
2002/0187719 A1 12/2002 Schneider
2006/0168766 A1 8/2006 Lippincott
2008/0016624 A1 * 1/2008 Osborn ..... A63H 33/006 5/658
2008/0020672 A1 * 1/2008 Osborn ..... A63H 33/006 446/227
2008/0134432 A1 6/2008 Brandon
2008/0215092 A1 9/2008 Smith
2009/0030455 A1 1/2009 Dallman
2009/0081921 A1 3/2009 Urueta
2009/0191783 A1 7/2009 Spitzer et al.
2009/0255028 A1 10/2009 Weisblatt
2009/0270010 A1 * 10/2009 Scott ..... A63H 3/003 446/73
2010/0062677 A1 3/2010 Savoni et al.
2010/0234887 A1 * 9/2010 Smith ..... A61J 17/007 606/236
2010/0304636 A1 12/2010 Seiz
2010/0317252 A1 12/2010 Raimondi
2011/0224730 A1 9/2011 Holley
2012/0041487 A1 * 2/2012 Griffis ..... A45F 5/02 606/234
2012/0322337 A1 * 12/2012 Theodory ..... A63H 3/005 446/73

* cited by examiner

FIG. 52
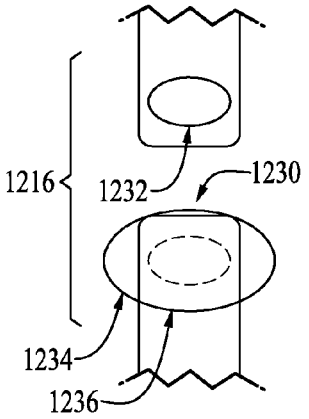
FIG. 53
FIG. 54
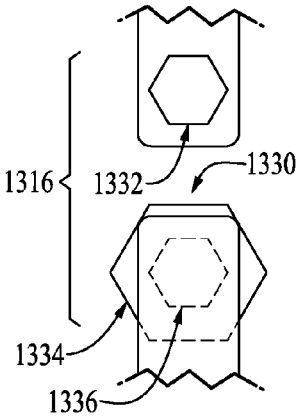
FIG. 55
FIG. 56
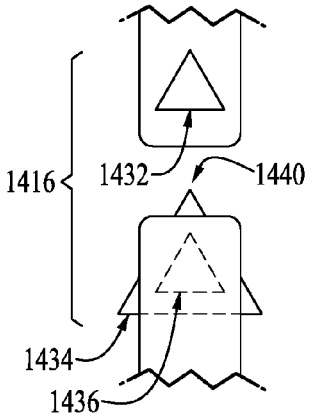
FIG. 57

FIG. 62
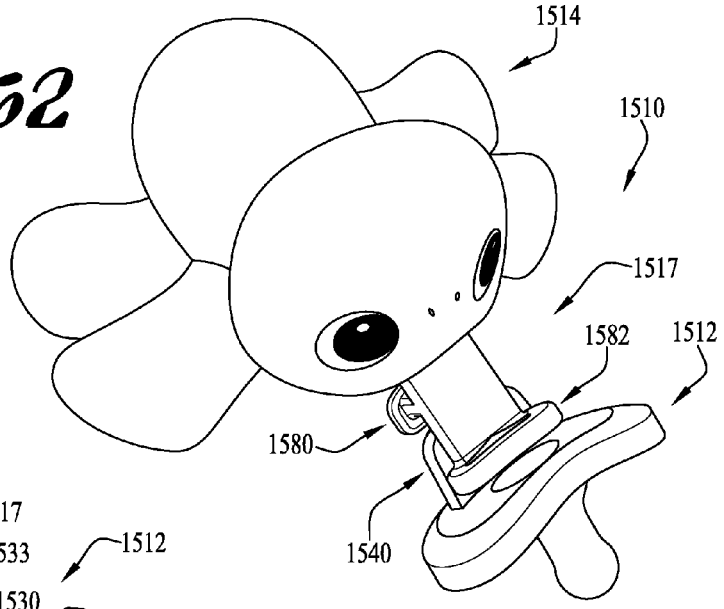
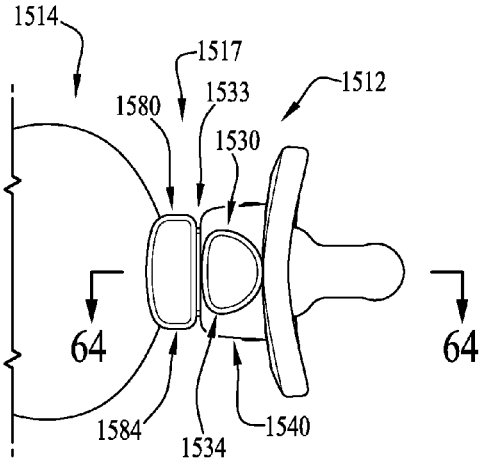
FIG. 63
FIG. 64
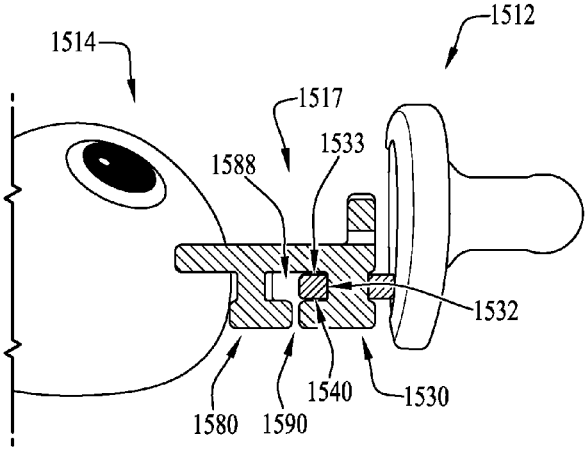

FIG. 65
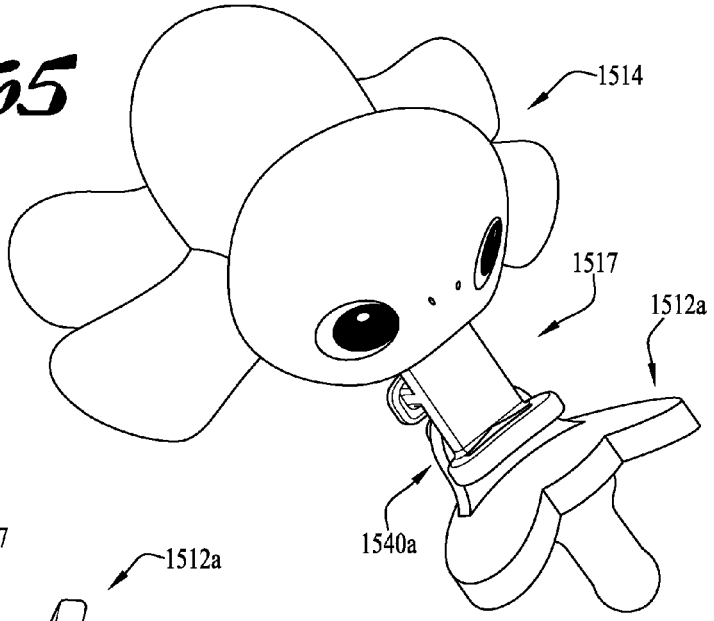
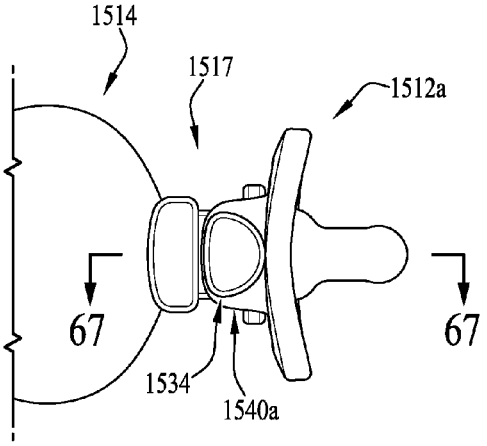
FIG. 66
FIG. 67
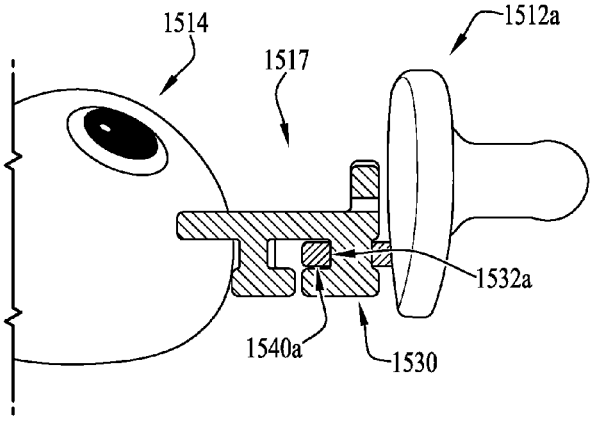

FIG. 68
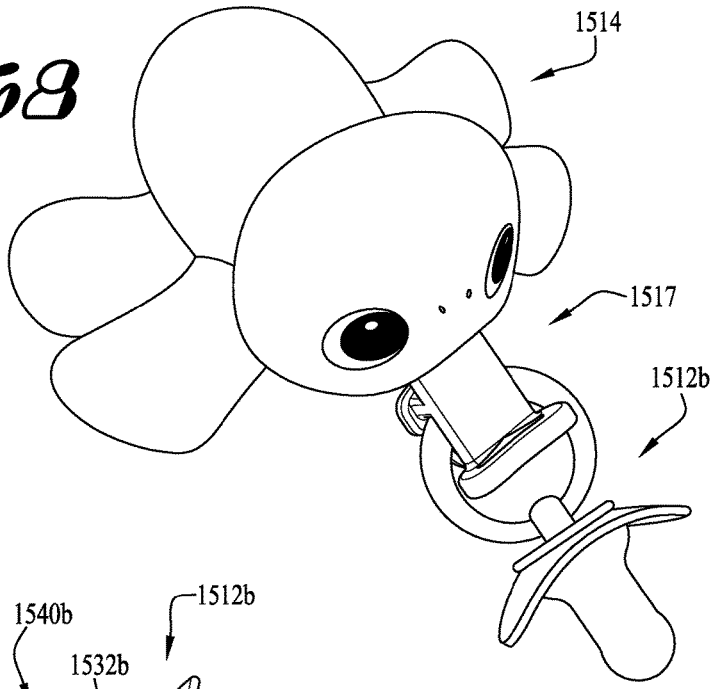
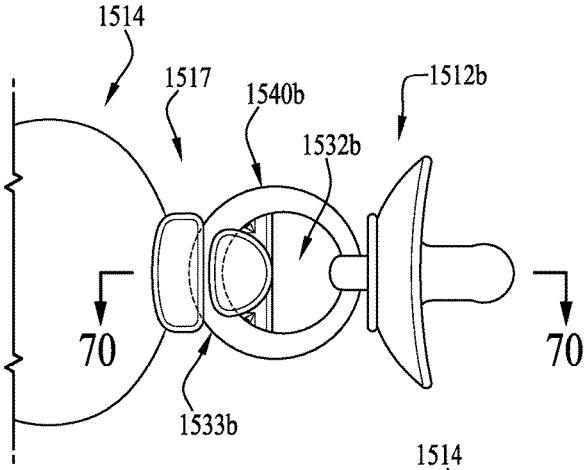
FIG. 69
FIG. 70
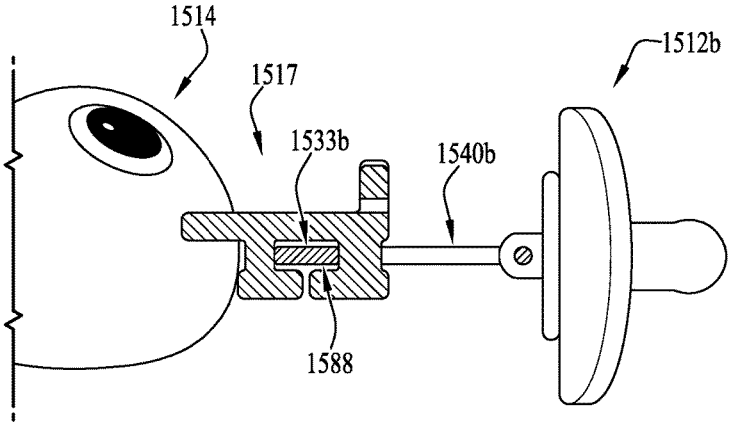

TOY WITH MULTI-CONNECTOR FOR DIFFERENT STYLES OF SOOTHING DEVICES

CROSS-REFERENCE TO RELATED APPLICATIONS

This application is a continuation-in-part of U.S. Non-Provisional patent application Ser. No. 14/173,933 filed Feb. 6, 2014, which claims the priority benefit of U.S. Provisional Patent Application Ser. No. 61/763,680 filed Feb. 12, 2013, and U.S. Provisional Patent Application Ser. No. 61/761,277 filed Feb. 6, 2013, the entireties of which are hereby incorporated herein by reference for all purposes.

TECHNICAL FIELD

The present invention relates generally to the field of infant oral suckling accessories, and more particularly to soothing devices such as pacifiers and teethers.

BACKGROUND

Infant oral soothing devices are thought to provide comfort to infants by providing them the opportunity to act on oral tendencies such as sucking, chewing, and generally placing things in their mouths. Such soothing devices include pacifiers and teethers, and are additionally thought to actually reduce pain and provide delight, with teethers especially comforting to infants when they are teething. In addition, it is known to combine pacifiers with plush toys intended to provide amusement and/or comfort to infants. Such combined pacifier-toy devices include those disclosed by U.S. Pat. No. 6,666,740 and U.S. Patent Publication No. 2010/0234887.

While such pacifier-toy combinations appear to demonstrate potential benefits, there remain concerns about them. For example, in some combination devices the toy and the pacifier are separable for cleaning and independent use, but too easily so such that the toy and/or pacifier can too easily fall to the ground and become dirty, or such that certain coupling components present a choking hazard. And in some other combination devices the plush toy and the plastic pacifier are not separable, but then they cannot be separately cleaned as needed for proper sanitary conditioning.

Accordingly, it can be seen that needs exist for improvements in combination pacifier-toy devices to provide for ease of cleaning, sanitary use, and safety of use. It is to the provision of solutions meeting these and other needs that the present invention is primarily directed.

SUMMARY

Generally described, the invention relates to a combination soother-toy device that includes a soothing device, a toy, and a coupling that removably attaches them together. The soothing device can be for example a pacifier or alternatively a teether, and the toy can be for example a plush animal character or alternatively a ball or noise-maker. The detachment coupling permits the pacifier and the toy to be separated for independent use and/or cleaning.

In one aspect of the invention, the detachment coupling includes a transverse tab and a transverse opening that couple and decouple by a transverse motion through which the tab transversely inserts into and withdraws from the opening. In this way, the axial pulling motion and forces that babies often apply to the toy when holding the pacifier in its mouth do not cause the components to separate. In one such example embodiment, the tab includes a retaining head at the end of a transverse connecting arm that extends from an axial extension arm attached to the toy, and the opening includes a slot formed in an extension arm that extends axially from the pacifier.

In another aspect of the invention, a coupling element such as the tab (transverse or not) is retained on the toy by a primary attachment such as stitching and a secondary retainer for redundancy as a safety feature. In this way, in the unlikely event that the primary attachment fails, the secondary retainer will prevent the coupling element from separating and presenting a choking hazard. In example embodiments, the secondary retainer is in the form of a tether attaching the tab extension arm to the toy, or wings extending from the tab extension arm laterally beyond the toy opening through which the extension arm extends.

And in yet another aspect of the invention, a toy is provided, by itself or in combination a soothing device. In typical such embodiments, the toy includes a multi-connector configured with coupling elements that engage coupling elements of different styles of soothing devices. In this way, the toy can be used with any of a variety of different new or existing soothing devices to provide greater versatility. In example embodiments, the multi-connector of the toy includes a second generally parallel transverse tab extending from the same side of the axial extension arm, a third slotted transverse tab extending from the opposite side of the axial arm, or both.

These and other aspects, features, and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are exemplary and explanatory of typical embodiments of the invention, and are not restrictive of the invention as claimed.

BRIEF DESCRIPTION OF THE DRAWINGS

FIGS. 17-18 show the pacifier and toy of FIG. 3 being decoupled apart.

FIG. 52 is a top view of a pacifier portion of a combination pacifier-toy device according to a thirteenth example embodiment of the invention.

FIG. 53 is a top view of a toy portion of the combination pacifier-toy device of FIG. 52.

FIG. 54 is a top view of a pacifier portion of a combination pacifier-toy device according to a fourteenth example embodiment of the invention.

FIG. 55 is a top view of a toy portion of the combination pacifier-toy device of FIG. 54.

FIG. 56 is a top view of a pacifier portion of a combination pacifier-toy device according to a fifteenth example embodiment of the invention.

FIG. 57 is a top view of a toy portion of the combination pacifier-toy device of FIG. 56.

FIG. 62 is a perspective view of the toy of FIG. 58 shown removably attached to the pacifier of the first example embodiment.

FIG. 63 is a bottom view of a proximal portion of the toy and the removably attached pacifier of FIG. 62.

FIG. 64 is a cross-sectional view of the toy proximal portion and the removably attached pacifier taken at line 64-64 of FIG. 63.

FIG. 65 is a perspective view of the toy of FIG. 58 shown removably attached to a first alternative style pacifier.

FIG. 66 is a bottom view of a proximal portion of the toy and the removably attached pacifier of FIG. 65.

FIG. 67 is a cross-sectional view of the toy proximal portion and the removably attached pacifier taken at line 67-67 of FIG. 66.

FIG. 68 is a perspective view of the toy of FIG. 58 shown removably attached to a second alternative style pacifier.

FIG. 69 is a bottom view of a proximal portion of the toy and the removably attached pacifier of FIG. 68.

FIG. 70 is a cross-sectional view of the toy proximal portion and the removably attached pacifier taken at line 70-70 of FIG. 69.

DETAILED DESCRIPTION OF EXAMPLE EMBODIMENTS

Figure 1:
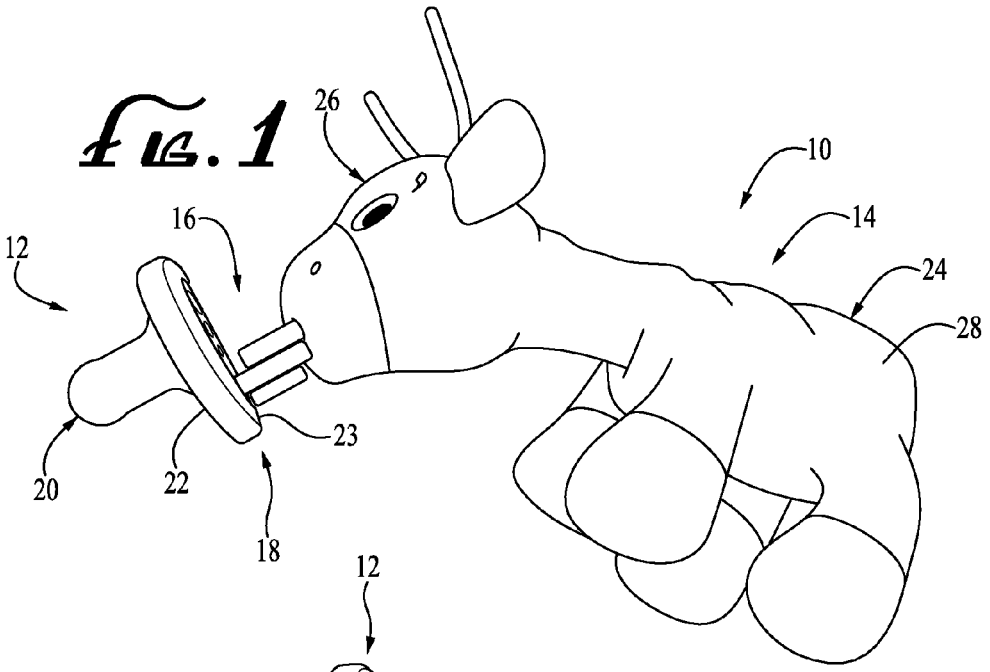
FIG. 1 is a perspective view of a combination pacifier-toy device according to a first example embodiment of the present invention, including a pacifier, a toy, and a coupling detachably connecting them together.
Figure 2:
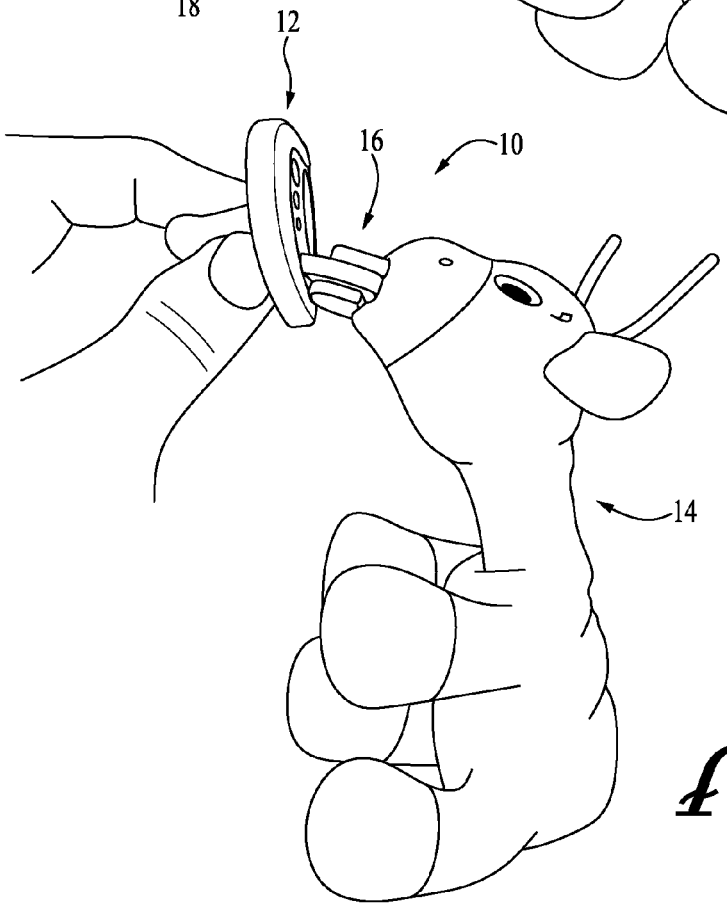
FIG. 2 shows the device of FIG. 1 in a use position with the pacifier being held and the toy suspended therefrom.
Figure 3:
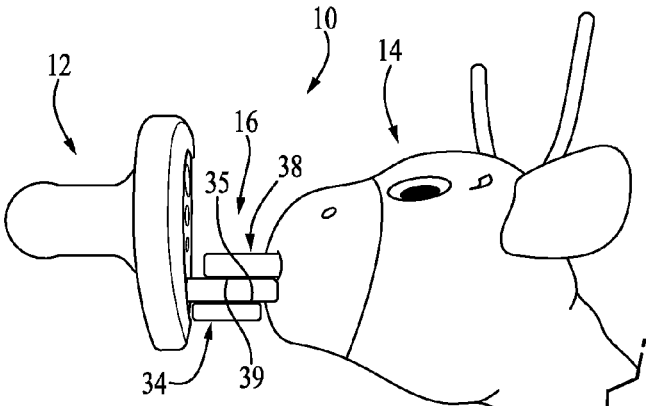
FIG. 3 is a side view of the pacifier, the coupling, and a portion of the toy of FIG. 1.
Figure 4:
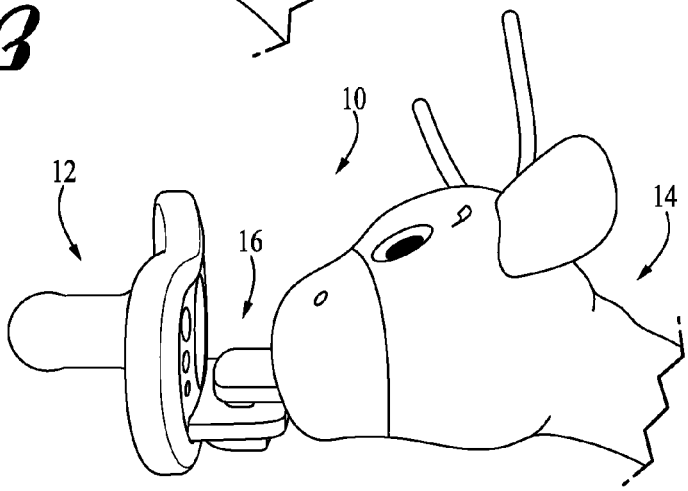
FIG. 4 is a top-side perspective view of the device portions of FIG. 3.
Figure 5:
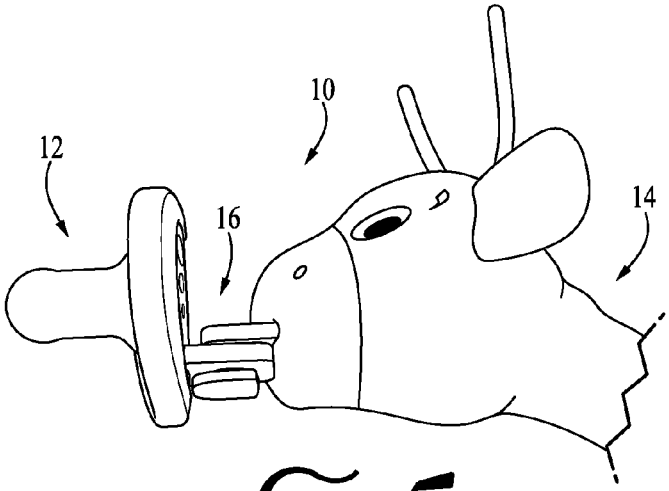
FIG. 5 is a bottom-side perspective view of the device portions of FIG. 3.
Figure 6:
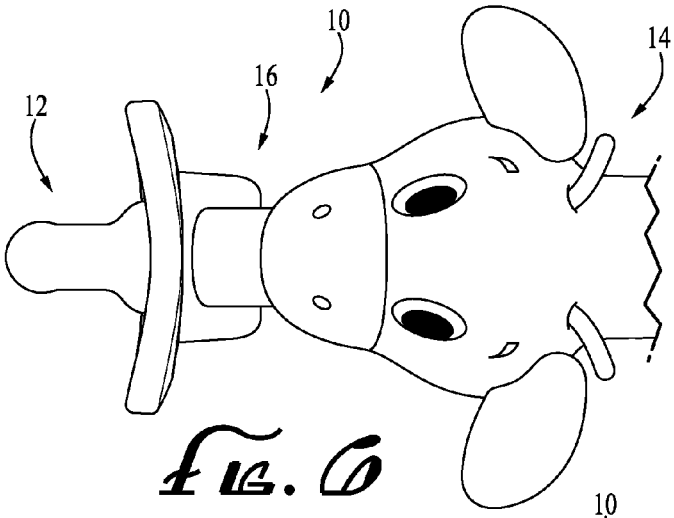
FIG. 6 is a top view of the device portions of FIG. 3.
Figure 7:
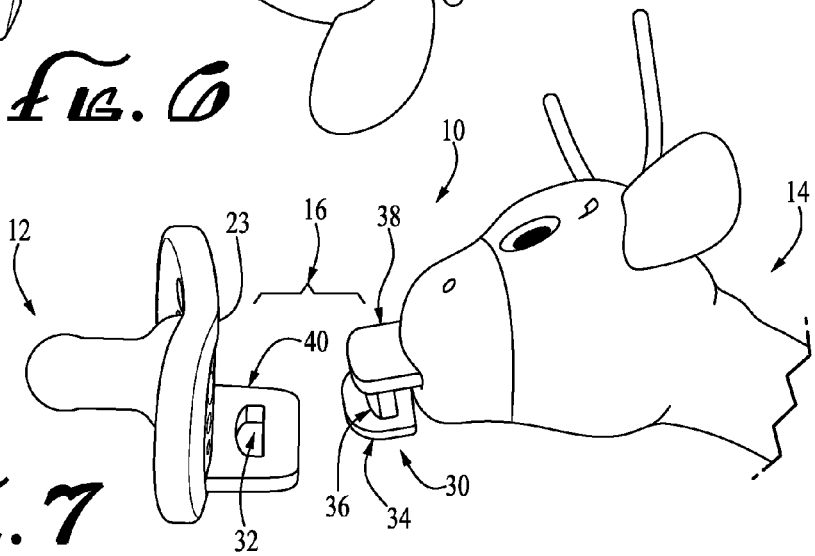
FIG. 7 shows the pacifier and toy of FIG. 4 detached from each other.
Figure 8:
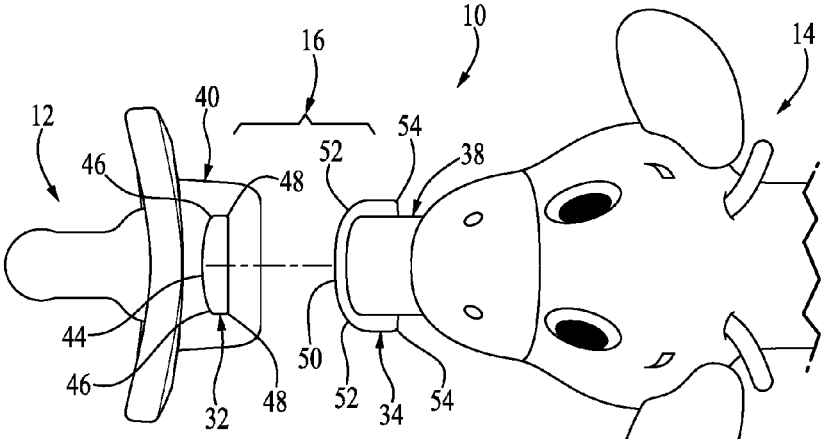
FIG. 8 is a top view of the detached device portions of FIG. 7.
Figure 9:
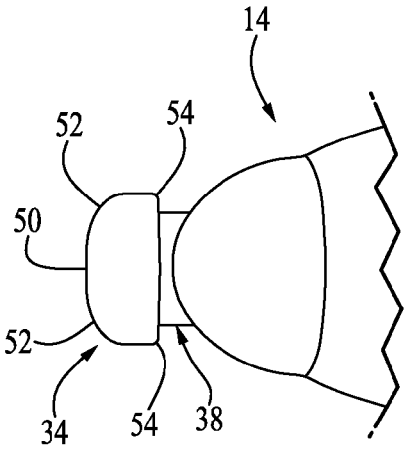
FIG. 9 is a bottom view of the portion of the toy and coupling of FIG. 8.
Figure 10:
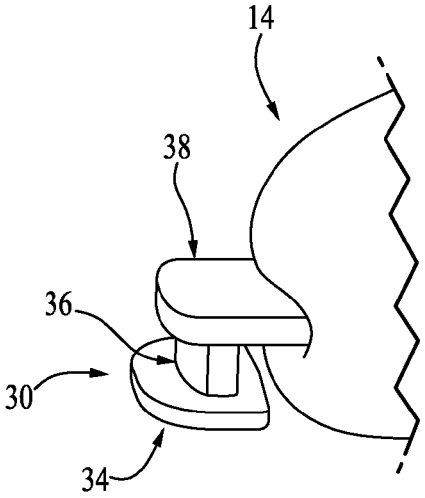
FIG. 10 is a top perspective view of the device portions of FIG. 9.
Figure 11:
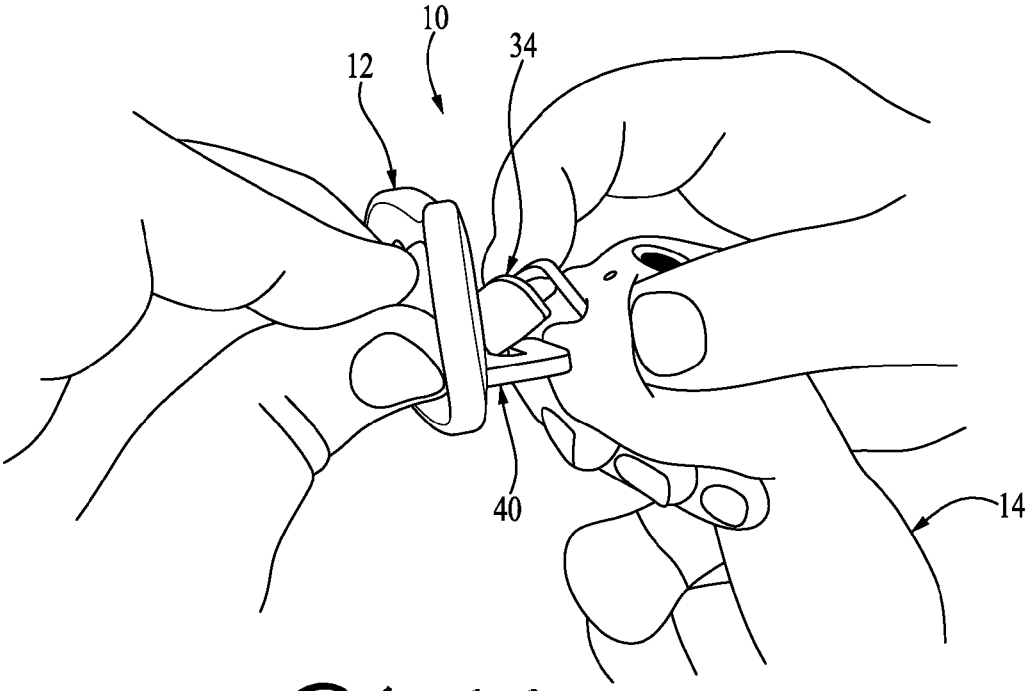
FIG. 11 is a perspective view of the device of FIG. 1 showing a step of a coupling process in which the pacifier and toy are coupled together.
Figure 12:
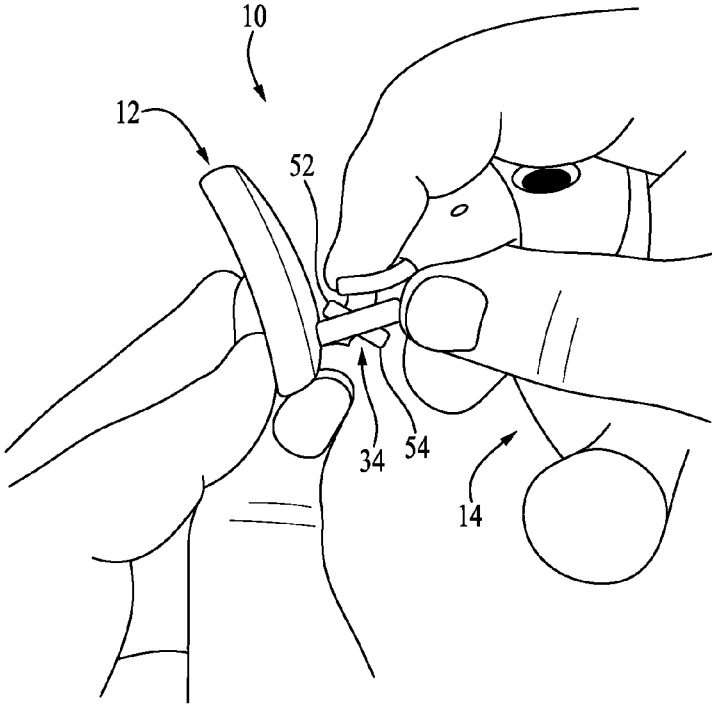
FIG. 12 is a side view of the device of FIG. 11 showing a next step of the coupling process.
Figure 13:
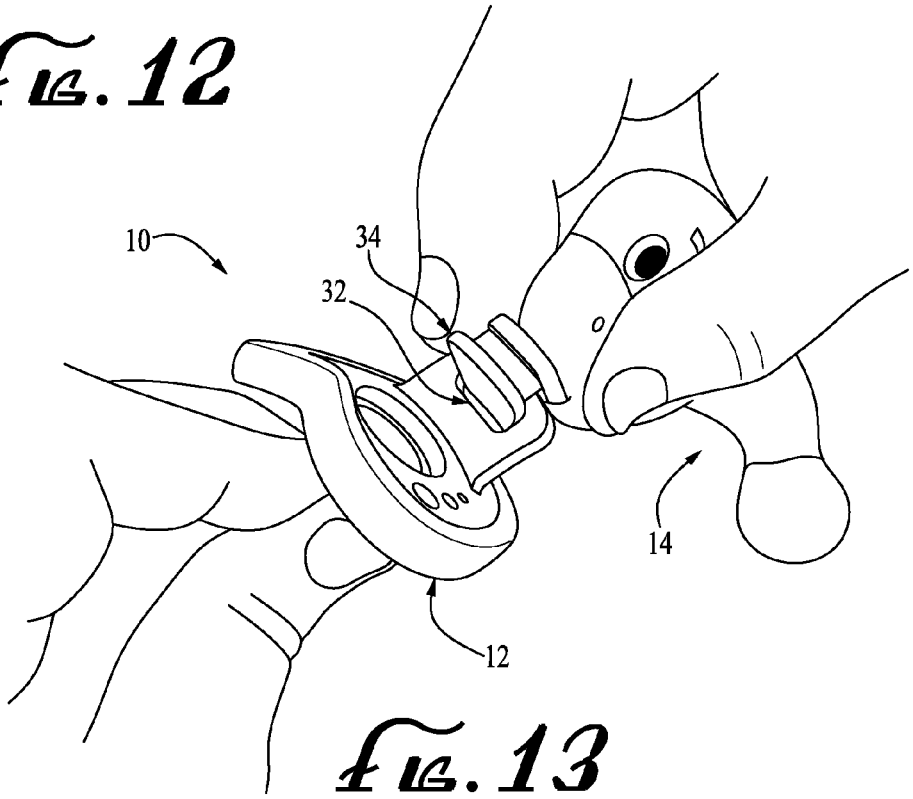
FIG. 13 is a top perspective view of the device of FIG. 12.
Figure 14:
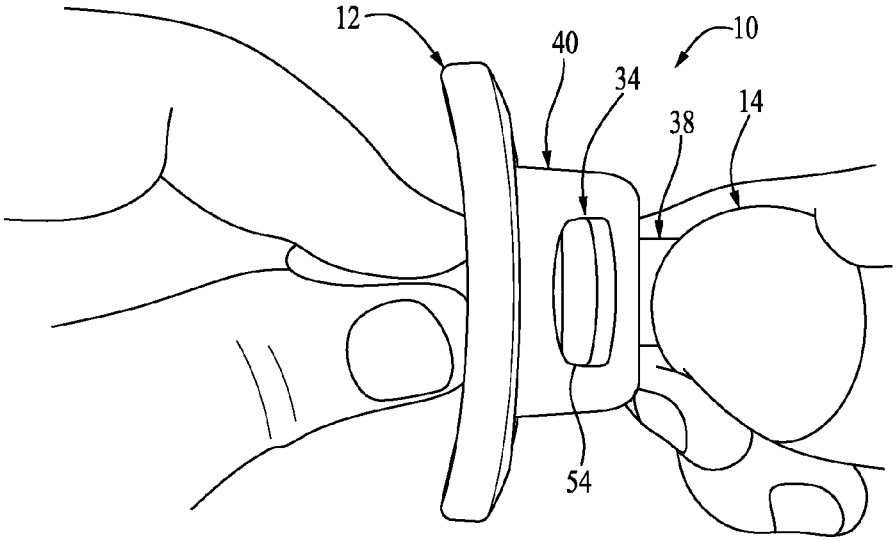
FIG. 14 is a bottom view of the device of FIG. 12.
Figure 15:
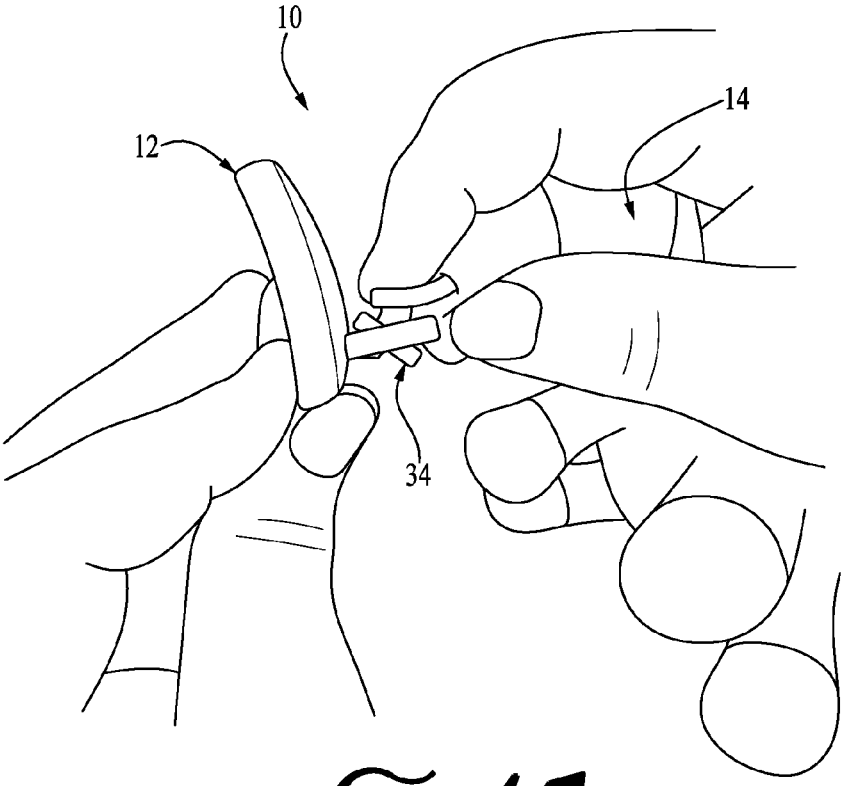
FIG. 15 is a side view of the device of FIG. 12 showing a next step of the coupling process.
Figure 16:
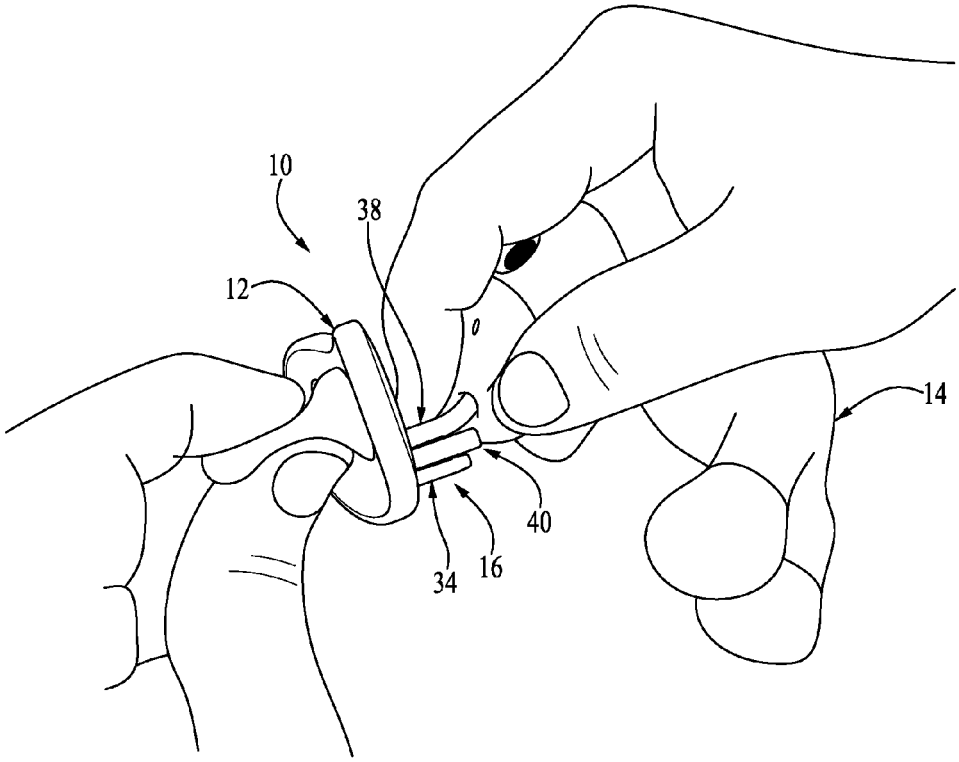
FIG. 16 shows the device of FIG. 15 in the coupled position at the end of the coupling process.
Figure 17:
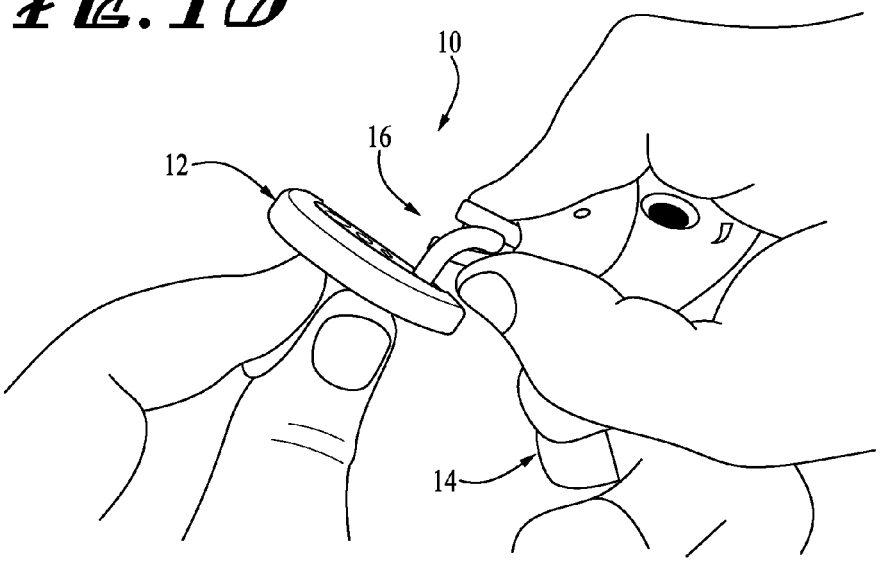
FIG. 17 is a side view of the device of FIG. 15 showing a step of a decoupling process in which the pacifier and toy are separated from each other.
Figure 18:
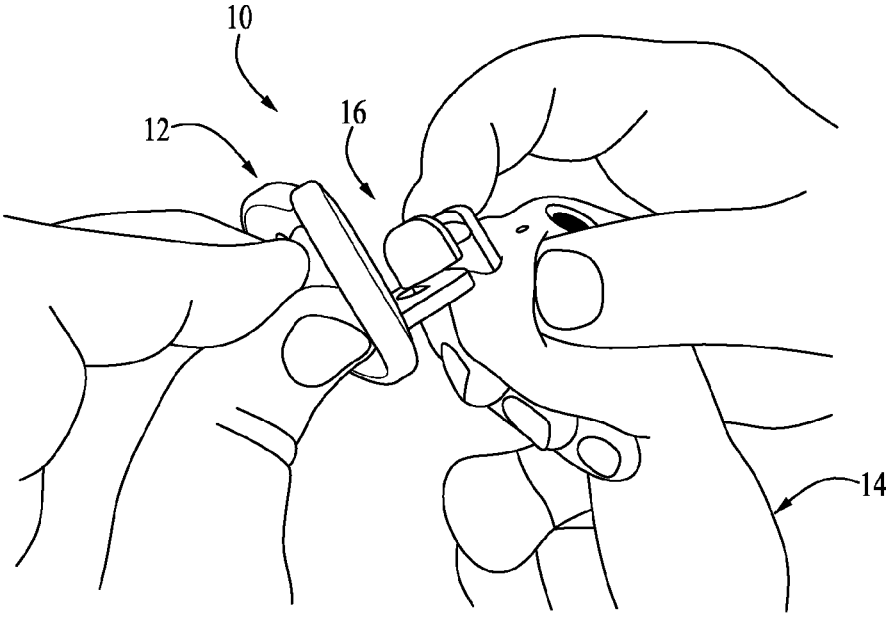
FIG. 18 is a perspective view of the device of FIG. 17 showing the pacifier and toy separated from each other at the end of the decoupling process.
Figure 19:
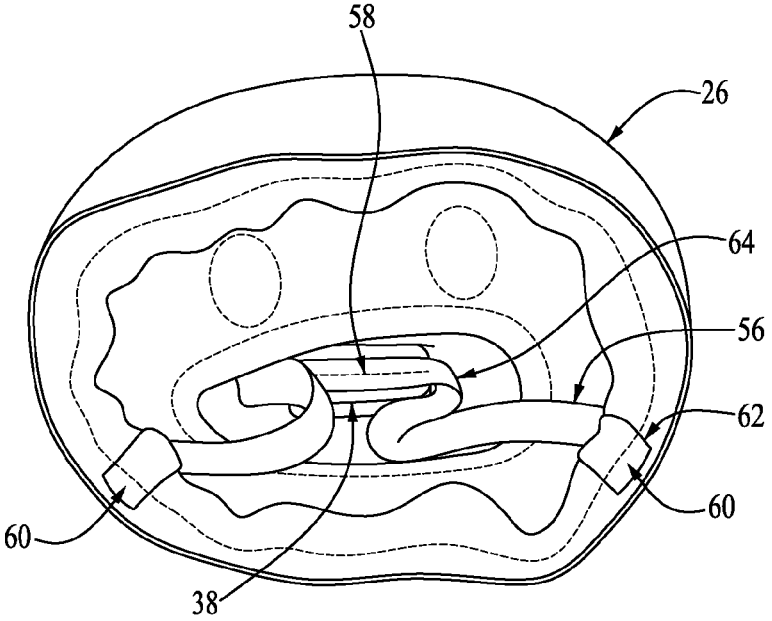
FIG. 19 is a top-rear perspective view of a head portion of the toy of FIG. 1, with a body portion of the toy and with stuffing of the head portion removed to show internal components of the toy.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-22 show a combination soother-toy device 10 according to a first example embodiment of the invention. The soother-toy device 10 includes a soothing device 12, a toy 14, and a coupling 16 that functions to removably attach them together.

In the depicted embodiment, the soothing device 12 is a pacifier. In other embodiments, the soothing device is a teether or other device for providing soothing comfort to a baby. As such, although the invention is described herein with respect to a pacifier, it will be understood that instead other soothing devices can be provided and readily adapted to include the respective coupling portion. The basic design of the pacifier 12 can be of a conventional type, for example, including a flange 18 and a nipple 20 extending from a front side 22 of the flange. The pacifier can be made of conventional materials such as silicone, polypropylene (PP), ethylene vinyl acetate (EVA), acrylonitrile butadiene styrene (ABS), thermo-plastic rubber (TPR), which can be translucent, transparent with color, or opaque, and which can be formed with a durometer of for example about 30 to about 85 Shore A.

In some embodiments, a protective cover is provided for the pacifier 12. The cover can be removable or permanently attached to the pacifier 12. For example, the cover can be permanently attached to the pacifier 12 by a living hinge and repositionable between a covered position for storage and an uncovered position for use.

In the depicted embodiment, the toy 14 is a plush toy such as an animal character (e.g., a cow). In other embodiments, the toy is a ball, a noise-maker, or another toy for providing interest (e.g., amusement, entertainment, and/or education) to a baby. As such, although the invention is described herein with respect to a plush toy, it will be understood that other toys can be provided instead. The basic design of the plush toy 14 can be of a conventional type, for example, including a body 24 and a head 26 extending from the body, with both formed of a shell 28 made of a soft flexible material such polyester and stuffing (not shown) made of a soft flexible material such polyester substantially filling the shell for shape retention.

The detachment coupling 16 includes a transverse tab 30 and a transverse opening 32 that removably receives the transverse tab. In the depicted embodiment, the transverse tab 30 extends from the toy 14 and the transverse opening 32 is formed in the pacifier 12. In other embodiments, these two components are reversed, with the transverse tab extending from the pacifier and the transverse opening formed in the toy. To insert and remove the tab 30 through the opening 32, a motion is required that is transverse to the axis of the pacifier nipple 20 and the toy body 24 (for example, as described herein with respect to FIGS. 11-18). Of course, the toy 14 can be removed from the pacifier 12 by applying only an axial pulling force on the toy body 24 if that force is great enough, because the soft flexible coupling components will elastically deform (and eventually fail), but even in that event the result is typically still a transverse motion (though smaller) of the deformed tab 30 through the deformed opening 32.

This transverse arrangement of the tab 30 and the opening 32 keep the pacifier 12 and the toy 14 coupled together for use and enable easy detachment by a caretaker when desired for cleaning or independent use. Infants tend to pull on the toy body 24 in an axial direction, but do not tend to apply transversely-directed forces to the toy 14. Because transverse motion is required to detach the toy 14 from the pacifier 12, these components are not readily separated by the infant user. But a caregiver can easily transversely separate the toy 14 from the pacifier 12 as desired.

Figure 20:
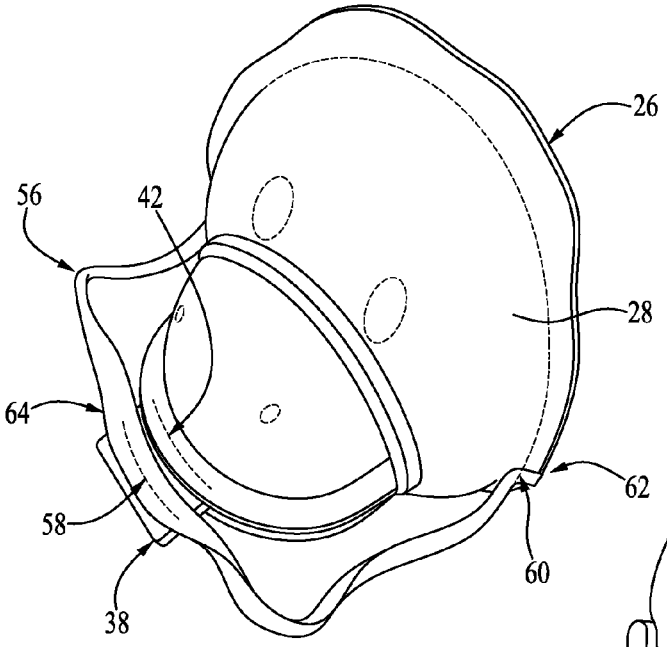
FIG. 20 is a top-side perspective view of the toy head portion of FIG. 19, with the head portion inverted (turned inside-out) to show internal (now external) components of the toy.
Figure 21:
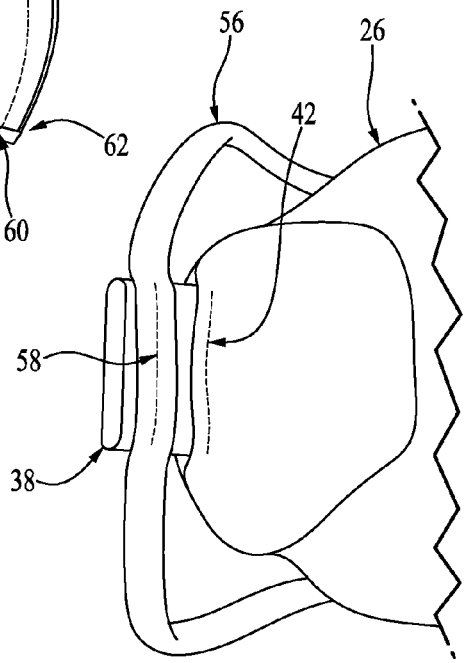
FIG. 21 is a top view of a portion of the toy head portion of FIG. 20.
Figure 22:
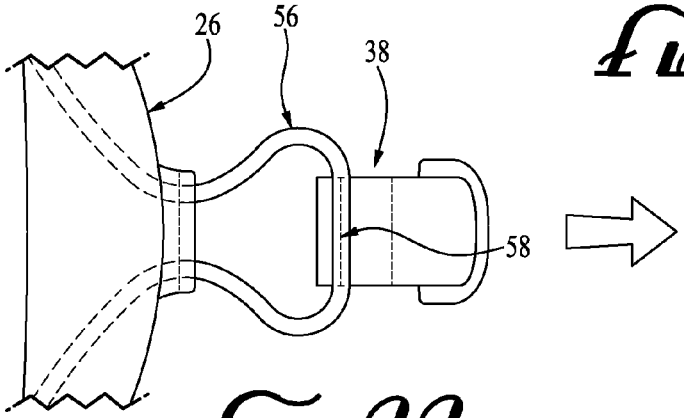
FIG. 22 is a top view of the toy head portion of FIG. 19, with an attachment of a toy coupling portion to the head portion having failed, but a secondary retainer securing them together.
Figure 23:
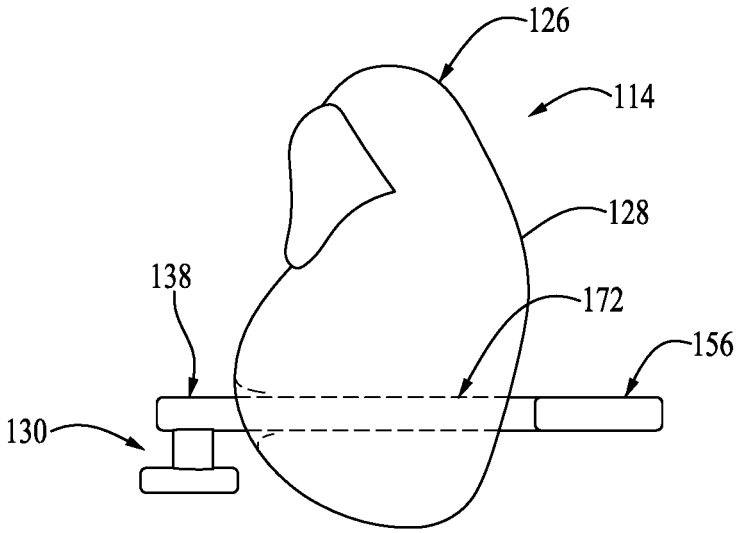
FIG. 23 is a side view of a head portion and a toy coupling portion of a toy of a combination pacifier-toy device according to a second example embodiment of the present invention, with a body portion of the toy and with stuffing of the head portion removed to show internal components of the toy.
Figure 24:
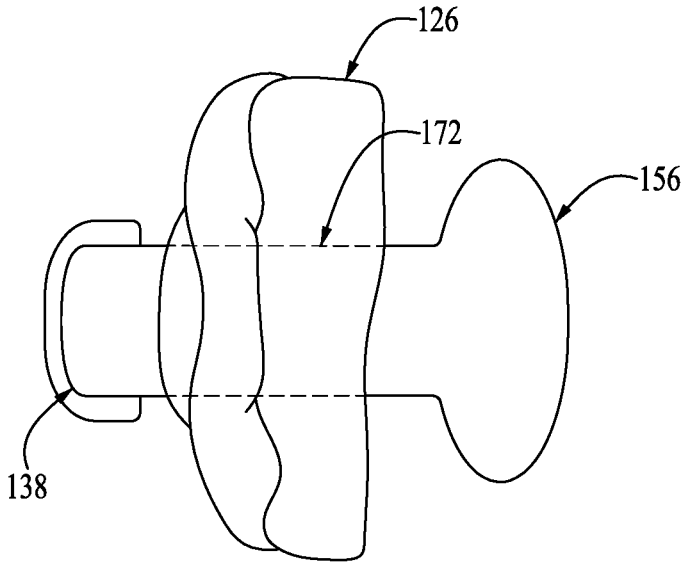
FIG. 24 is a top view of the toy head portion and coupling portion of FIG. 23.
Figure 25:
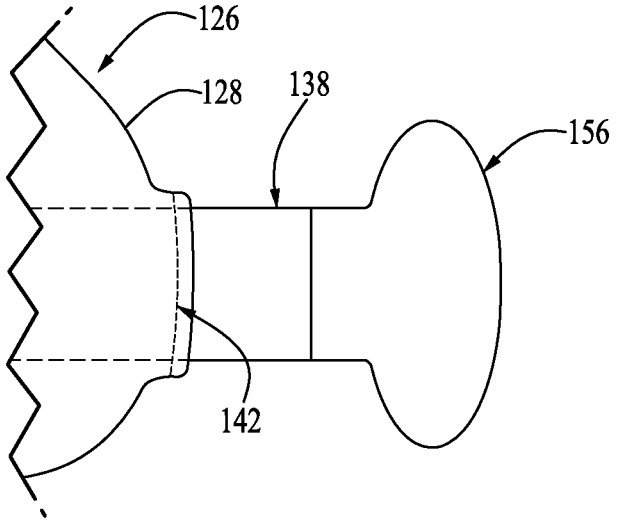
FIG. 25 is a detail view of the device portions of FIG. 24, with the head portion inverted (turned inside-out) to show internal (now external) components of the toy.
Figure 26:
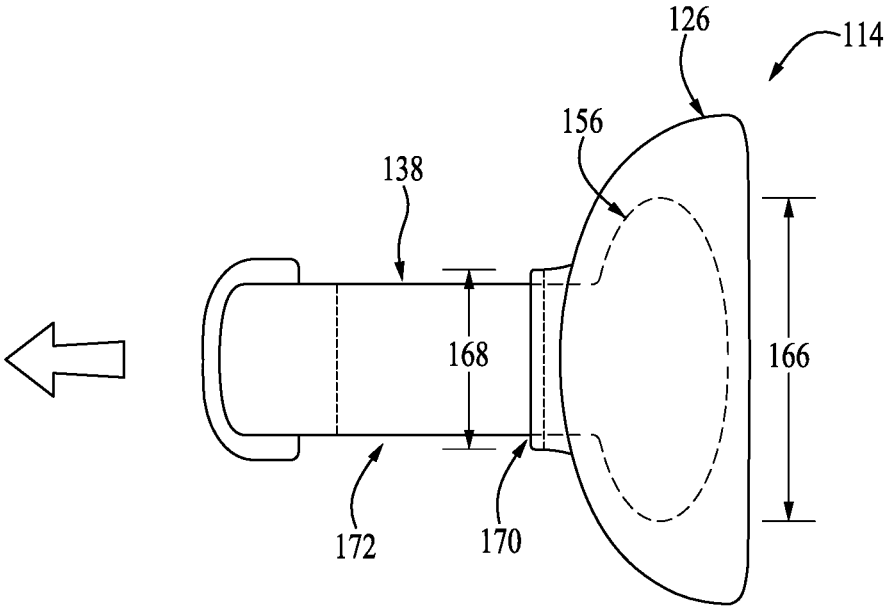
FIG. 26 shows the device portions of FIG. 24, with an attachment of the toy coupling portion to the head portion having failed, but a secondary retainer securing them together.

In the depicted embodiment, the tab 30 includes a transverse connecting arm 36 and a retaining head 34 at or adjacent its end. The connecting arm 36 extends transversely from an extension arm 38 that in turn extends from the toy 14 axially and parallel to the longitudinal axis of the toy body 24. The retaining head 34, the transverse connecting arm 36, and the axial extension arm 38 can all be in the form of generally flat panels or plates (as depicted), or bars, rods, or the like. In addition, the depicted opening 32 is in the form of a slot defined by an extension arm 40 extending from the flange 18 axially and parallel to (e.g., offset from and below) the longitudinal axis of the nipple 20. The tab extension arm 38 can be permanently fixed to the toy 14, for example at a mouth of the toy head 26, by an attachment 42 such as a conventional fastener for example stitching (as depicted in FIGS. 20-21), a button, a snap, an adhesive, or another conventional fastener. And the slot extension arm 40 can be integrally formed with the pacifier 12 as a single piece, for example extending from a back side 23 of the flange 18 in a direction defined by the axis of the nipple 20. In other embodiments, the tab extension arm is an integrally formed part and/or the slot extension arm is permanently attached by conventional fasteners. In typical embodiments such as that depicted, the tab 30 and the slot 30 have a uniform thickness and configuration so that the coupling 16 is reversible, that is, the tab can be inserted through the slot from either side (e.g., from the top or the bottom).

The tab retaining head 34 is sufficiently larger than the slot 32 so that when they are coupled together the retaining head will not pass back through the slot absent a transverse relative motion being generated between the two parts. But the tab retaining head 34 is not so much larger than the slot 32 that the two parts cannot be easily coupled and decoupled by the soft flexible retaining head and slot extension arm 40 deforming to allow the retaining head through upon the transverse relative motion being generated between the two parts.

It should be noted that the transverse tab and opening can be provided in a number of different forms other than those expressly described herein. For example, in some embodiments the transverse tab and/or opening are strictly perpendicular to the nipple axis (as depicted), and in other embodiments they are not (i.e., they extend in a direction having a perpendicular and an axial component). Also, the transverse connecting arm, retaining head, and/or transverse opening can be provided in a number of different shapes, for example round/cylindrical, triangular, elliptical, hexagonal, or another polygonal or other regular or irregular shape. In other embodiments, the retaining head does not circumscribe the transverse connecting arm and instead extends only partially, discontinuously, or intermittently around the periphery of the connecting arm. And in still other embodiments, a series or array of transverse tabs are provided for engaging only one or a series or array of transverse openings. a series or array of transverse tabs are provided for engaging only one or a series or array of transverse openings.

To facilitate the transverse-motion coupling and decoupling of the tab retaining head 34 and the slot 32, these components can be specially designed. In the depicted embodiment (see FIGS. 7-10), for example, the slot 32 is generally rectangular except with a curved front edge 44 and thus typically two curved front corners 46, while the two back corners 48 are generally squared (with "front" being closer to the mouth of the baby using the pacifier 12). And the depicted tab retaining head 34 is generally rectangular except with a curved front edge 50 and thus typically two curved front corners 52, while the two back corners 54 are generally squared. An advantage of this arrangement is illustrated by the following description of the use of the device 10.

FIGS. 11-18 show how the pacifier 12 and the toy 14 can be easily coupled and decoupled by the transverse motion. To couple them together, first one squared corner 54 of the tab retaining head 34 is transversely inserted into one of the squared corners 48 of the pacifier slot 32 (see FIG. 11), then the other (see FIG. 12). When the second squared corner 54 of the tab retaining head 34 is transversely inserted into the pacifier slot 32, the retaining head deforms into a smaller profile and/or the slot deforms into a larger profile by the force of their contacting engagement. So both squared corners 54 of the tab retaining head 34 are now transversely inserted into and through the slot 32 adjacent (below) the slot squared corners 48, but the opposing curved corners 52 of the tab retaining head 34 are not (see FIGS. 13-14). Then the tab retaining head 34 is pivoted (see FIG. 15) to engage the slot 32 (i.e., its inner surface) and thereby deform and swing its curved corners 52 past the deforming slot curved corners 46 and through the slot, until the retaining head and slot resiliently return to their neutral/undeformed states and the detachable coupling 16 is in the attached position for use (see FIG. 16). In this attached or coupled position, facing surfaces 35 and 39 of the tab retaining head 34 and the tab extension arm 38 are generally parallel, facing each other, and on opposite sides of the slot extension arm 40. As can be see, the transverse motion/force need not be solely in a transverse direction, rather the motion/force can be pivotal/angular with a transverse component and an axial component. To detach the toy 14 from the pacifier 12, the toy retaining head 34 is pivoted back (see FIG. 17) and then transversely pulled (see FIG. 18) from the slot 32.

The detachment coupling 16 components can be made of conventional materials such as silicone, polypropylene (PP), ethylene vinyl acetate (EVA), acrylonitrile butadiene styrene (ABS), and/or thermo-plastic rubber (TPR), they can be translucent, transparent with color, or opaque, and they can be formed with a durometer of for example about 30 to about 85 Shore A. In particular, in some embodiments the tab extension arm 38 is less than 1-¼ inches, and in such embodiments (e.g., with the tab extension arm 38 about 1 inch to about 1-⅛ inches) it is made of a material with a durometer of about 5 to about 70 Shore A, for example about 50 to about 55 Shore A. For smaller parts, the lower duromater (and thus softer material) help prevent them from becoming a possible a choking hazard (in the event they became separated and loose) and conform to certain U.S. and European safety standards.

In some embodiments, the tab 30 and the tab extension arm 38 are made of a material with a durometer of about 5 to about 70 Shore A, preferably about 60 Shore A, and the slot extension arm 40 is made of a material with a durometer of about 5 to about 70 Shore A, preferably about 40 Shore A, to result in a detachable coupling 16 with a net axial pull-away force (on the pacifier 12 and/or the toy 14 to separate them) being about 0.1 lb to about 10 lbs, preferably about 3 lbs. to about 5 lbs., and with net transverse insertion and separation forces on the pacifier and/or the toy to attach and detach them being less than that. In this arrangement, the toy 14 can be easily separated by a caregiver with the dexterity and hand strength to manipulate the tab 30 transversely relative to the slot 32, but cannot by an infant who will generally only pull on the toy applying axial forces too small to decouple the components.

In addition, the components of the detachment coupling 16, primarily the tab and slot extension arms 38 and 40, can be made of a material and/or have a structural design so that the axis of the toy body 24 does not droop and angle relative to the axis of the pacifier nipple 20 by a significant degree.

In typical embodiments, for example, the tab and slot extension arms 38 and 40 are designed so that the axis of the toy body 24 does not droop and angle relative to the axis of the pacifier nipple 20 by more than about 30 degrees.

A plurality of the pacifiers 12 and/or the toys 14 can be packaged together or individually for use together. Because the couplings 16 are universal, when one toy 14 (for example in the form of a cow) has been detached from the pacifier 12 and is being laundered, a different toy (for example in the form of a frog) can be attached to the pacifier for continued use. Or the separated pacifiers 12 and/or the toys 14 can be used independently when desired and then coupled together for joint use when desired. In other embodiments, the toy portion of the coupling is adapted for detachably connecting to standard pacifiers (i.e., without the pacifier portion of the coupling).

The combined pacifier-toy device 10 provides a number of additional benefits. The weight of the toy 14 helps keep the pacifier 12 in the baby's mouth. The toy 14 provides an entertainment feature for a baby sucking on the pacifier 12. The combined pacifier-toy device 10 is easier to find in a diaper bag. And the pacifier 12 can be removed when the child is older to facilitate breaking the attachment to the pacifier by allowing the child to continue playing with the detached toy 14 by itself.

In some embodiments the device includes a safety feature to ensure that the transverse tab does not detach from the toy and present a choking hazard. This safety feature can be included in any type of combination pacifier-toy device in which the toy detaches from the pacifier. Thus, in some embodiments this safety feature is included in pacifier-toy devices including a toy coupling portion that is attached to the toy but not one with a transverse tab or slot.

Referring particularly to FIGS. 19-22, this safety feature includes a redundant retaining element 56 that attaches the transverse tab 30 to its component (the toy 14 in this embodiment). That is, the retaining element 56 is a secondary or back-up feature to the primary attachment 42, which is designed to be robust and withstand any forces it might be subjected to but nevertheless could conceivably fail upon mistreatment or abuse of the device 10. In the depicted embodiment, the secondary retaining element is a tether (e.g., a strap or cord) 56 attached between the tab extension arm 38 and the shell 28 of the toy head 26 inside the shell (note that in FIGS. 20-21 the toy head is turned inside out). The tether 56 can be attached to the tab extension arm 38 and the shell 28 by attachments 58 and 60, respectively, such as stitching or other conventional fasteners. The tether 56 can be attached to the shell 28 at its two ends 62 and attached to the tab extension arm 38 at an intermediate portion 64 (as depicted) to effectively provide two tethers, it can attach to the shell and extension arm at its two ends, or additional ethers can be provided.

Typically, the tether 56 includes some extra length or slack, that is, the length of the tether between attachment points is greater than the distance between the attachments. In this way, the attachments 58 and 60, as well as the tether 56 itself, are not subjected to detachment forces when the baby pulls the toy 14 axially away from the pacifier 12, as babies tend to do. So the tether 56 and the attachments 58 and 60 do not assist in withstanding detachment forces during the normal lifetime use of the device 10, and instead the primary attachment 42 bears the full load. This helps ensure the structural integrity of the tether 56 so it is intact and ready for use if needed. In the unlikely event that the primary attachment 42 fails, pulling axially on the toy 14 while holding the pacifier 12 will cause the tab extension arm 38 to slide forward relative to the toy head 26 until the extra length or slack in the tether 56 is taken up and the tether is tensioned now bearing the full load of the axial detachment forces to retain the extension arm from further axial movement and from separation from the toy.

In addition, this arrangement provides for a visual indication to caregivers in the unlikely event that the primary attachment 42 fails. This is because the extra length or slack in the tether 56 permits the tab extension arm 38 to slide forward relative to the toy head 26 (see FIG. 22) when the toy 14 is pulled away from the pacifier 12 (as indicated by the directional arrow) and the primary attachment 42 fails, and this additional exposed length of the extension arm is readily noticeable to caregivers. The tether 56 is now engaged and retains the tab extension arm 38 to the toy 14, but the device 10 (or at least the toy 14) should now be replaced for safety reasons.

FIGS. 23-26 show a functionally similar safety feature of a combination pacifier-toy device according to a second example embodiment of the invention. In this embodiment, the redundant retaining element that attaches the transverse tab 130 to its component (the toy 114 in this embodiment) is at least one wing 156 extending laterally from the tab extension arm 138 inside the shell 128 (note that in FIG. 25 the toy head is turned inside out). Two wings 156 can be providing extending oppositely away from each other on opposite sides of the tab extension arm 138 (as depicted), or only one wing or more than two wings can be provided if desired. The wings 156 have a lateral dimension 166 that is greater than a lateral dimension 168 of the opening 170 in the shell 128 through which the tab extension arm 138 extends. As such, the wigs 156 cannot pass through the opening 170 and instead abut against the shell 128 adjacent the opening.

Typically, the tab extension arm 138 includes some extra length, that is, the extension arm includes a medial portion 172 between the primary attachment 142 and the wings 156 so that the wings are not adjacent the primary attachment and the shell 128 during normal use, and instead are positioned farther inside the shell 128. In this way, the wings 156 and the shell 128 adjacent the opening 170 are not subjected to detachment forces when the baby pulls the toy 114 axially away from the pacifier (not shown), as babies tend to do. So the wings 156 and the shell 128 adjacent the opening 170 do not assist in withstanding detachment forces during the normal lifetime use of the device 110, and instead the primary attachment 142 bears the full load. This helps ensure the structural integrity of the wings 156 and the shell 128 adjacent the opening 170 so they are intact and ready for use if needed. In the unlikely event that the primary attachment 142 fails, pulling axially on the toy 114 while holding the pacifier 112 will cause the tab extension arm 138 to slide forward relative to the toy head by the extra length of the tab extension arm until the wings 156 abut the shell 128 adjacent the opening 170 to now bear the full load of the axial detachment forces and retain the extension arm from further axial movement and from separation from the toy.

In addition, this arrangement provides for a visual indication to caregivers in the unlikely event that the primary attachment 142 fails. This is because the extra length provided by the medial portion 172 permits the tab extension arm 138 to slide forward relative to the toy head 126 (see FIG. 26) when the toy 114 is pulled away from the pacifier (as indicated by the directional arrow) and the primary attachment 142 fails, and this additional exposed length of the extension arm is readily noticeable to caregivers. The wings 156 now abut the shell 128 adjacent the opening 170 and retain the extension arm from sliding farther and out of the shell, but the device (or at least the toy 114) should now be replaced for safety reasons.

In other embodiments, the secondary retaining element is provided by another element that provides the same functionality of redundancy in retaining a portion of the coupling from separating from the toy. For example, the secondary retaining element can be in the form of a spring-biased retainer that deploys laterally outward upon failure of the primary attachment, a retainer mounted to the shell that engages an element of the extension arm, or another conventional retaining element known in the art that extends from or is mounted to the extension arm to be retained. It will be appreciated that the secondary retaining element need not fixedly attach the extension arm in a certain position relative to the toy (as the primary attachment does), it need only prevent separation of the extension arm from the toy.

Figure 27:
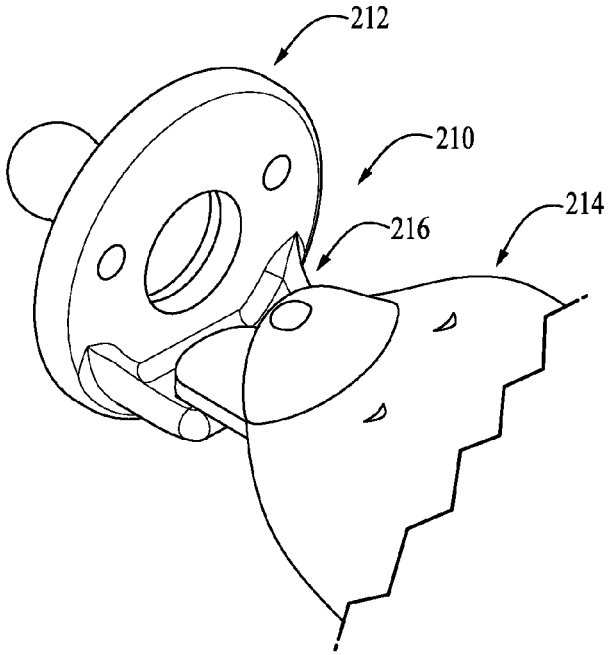
FIG. 27 is a top perspective view of a portion of a combination pacifier-toy device according to a third example embodiment of the present invention.
Figure 28:
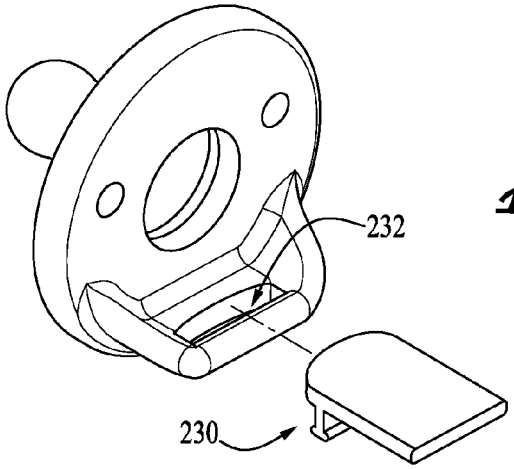
FIG. 28 shows the pacifier and toy of FIG. 27 detached from each other.

FIGS. 27-28 show a combination pacifier-toy device 210 according to a third example embodiment of the invention. This device 210 is similar to the embodiment described above in that it includes a pacifier 212, a toy 214, and a coupling 216 that removably attaches them together, with the coupling including a transverse tab 230 and a transverse opening 232 that couple and decouple by a transverse motion.

Figure 29:
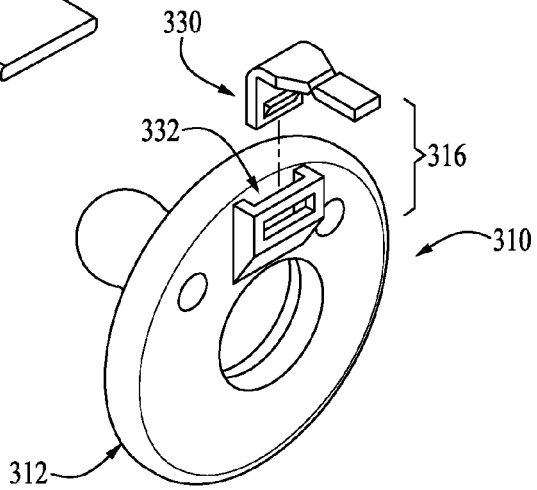
FIG. 29 is a perspective view of a portion of a combination pacifier-toy device according to a fourth example embodiment of the present invention.
Figure 30:
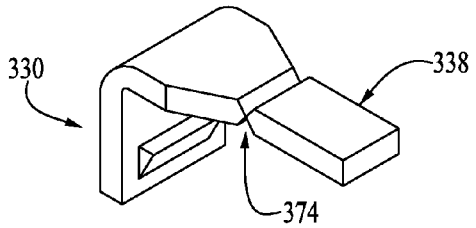
FIG. 30 shows a portion of the toy coupling portion of FIG. 29.

FIGS. 29-30 show a combination pacifier-toy device 310 according to a fourth example embodiment of the invention. This device 310 is similar to the embodiments described above in that it includes a pacifier 312, a toy (not shown), and a coupling 316 that removably attaches them together, with the coupling including a transverse tab 330 and a transverse opening 332 that couple and decouple by a transverse motion. In addition, this embodiment include a living hinge 374 in the tab extension arm 338 that permits the toy to more freely droop to angular positions when the pacifier is held in the infant's mouth.

Figure 31:
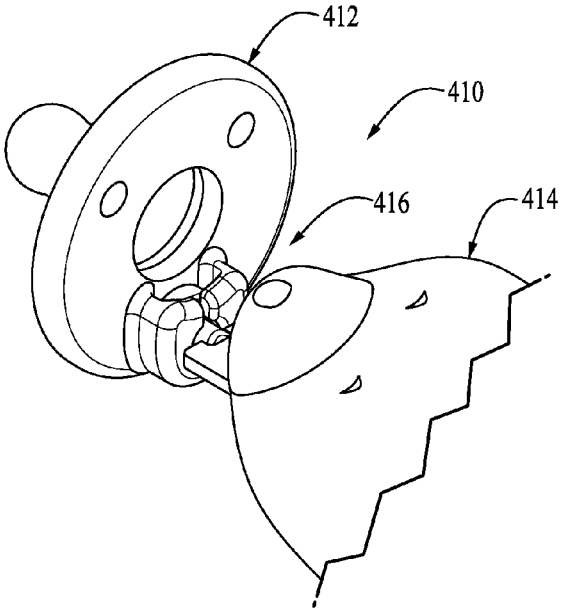
FIG. 31 is a top perspective view of a portion of a combination pacifier-toy device according to a fifth example embodiment of the present invention.
Figure 32:
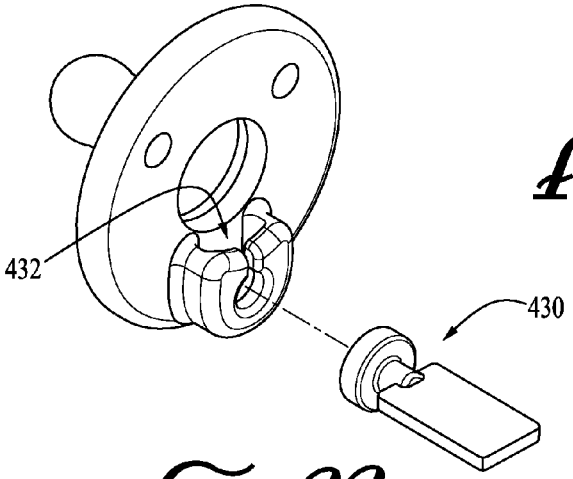
FIG. 32 shows the pacifier and toy of FIG. 31 detached from each other.

FIGS. 31-32 show a combination pacifier-toy device 410 according to a fifth example embodiment of the invention. This device 410 is similar to the embodiments described above in that it includes a pacifier 412, a toy 414, and a coupling 416 that removably attaches them together, with the coupling including a transverse tab 430 and a transverse opening 432 that couple and decouple by a transverse motion.

Figure 33:
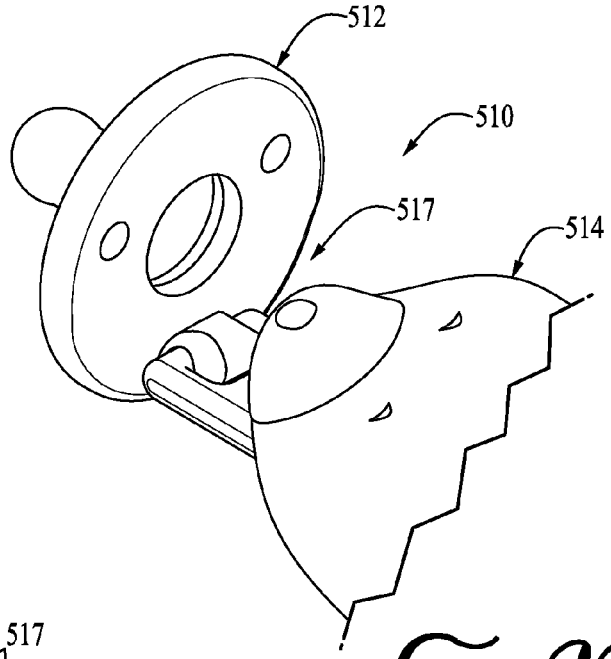
FIG. 33 is a top perspective view of a portion of a combination pacifier-toy device according to a sixth example embodiment of the present invention.
Figure 34:
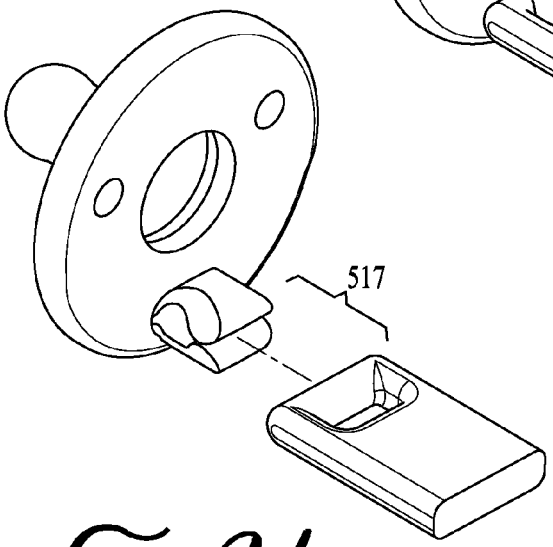
FIG. 34 shows the pacifier and toy of FIG. 33 detached from each other.

FIGS. 33-34 show a combination pacifier-toy device 510 according to a sixth example embodiment of the invention. This device 510 is similar to the embodiments described above in that it includes a pacifier 512, a toy 514, and a coupling 517 that removably attaches them together, but in this embodiment the coupling includes components that couple and decouple by an axial motion.

Figure 35:
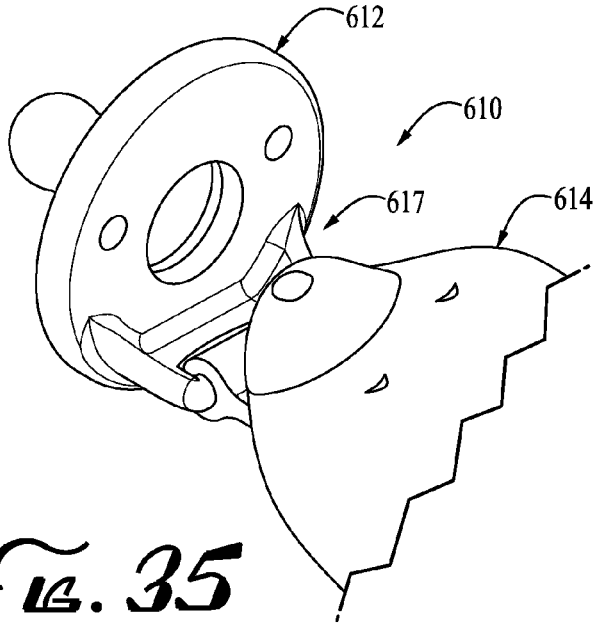
FIG. 35 is a top perspective view of a portion of a combination pacifier-toy device according to a seventh example embodiment of the present invention.
Figure 36:
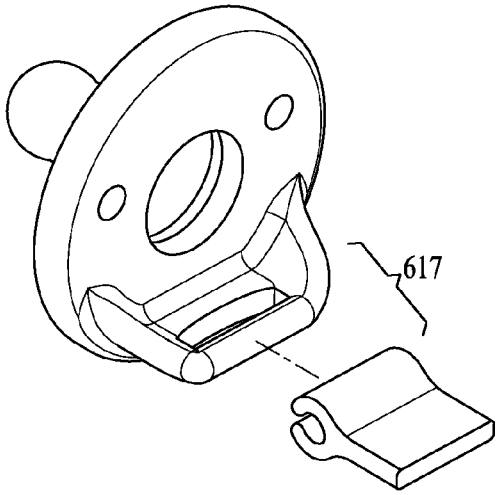
FIG. 36 shows the pacifier and toy of FIG. 35 detached from each other.

FIGS. 35-36 show a combination pacifier-toy device 610 according to a seventh example embodiment of the invention. This device 610 is similar to the embodiments described above in that it includes a pacifier 612, a toy 614, and a coupling 617 that removably attaches them together, but in this embodiment the coupling includes components that couple and decouple by an axial motion.

Figure 37:
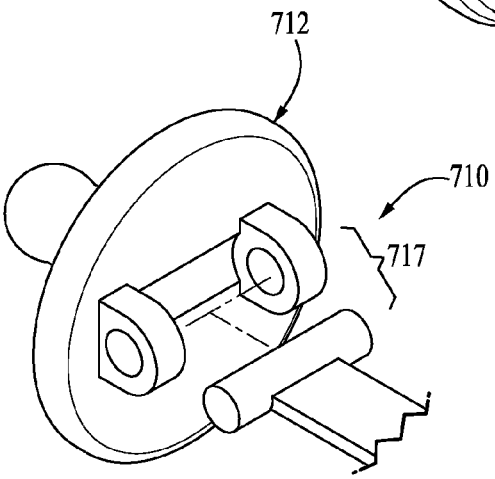
FIG. 37 is a top perspective view of a portion of a combination pacifier-toy device according to an eighth example embodiment of the present invention, with the pacifier and toy detached from each other.
Figure 38:
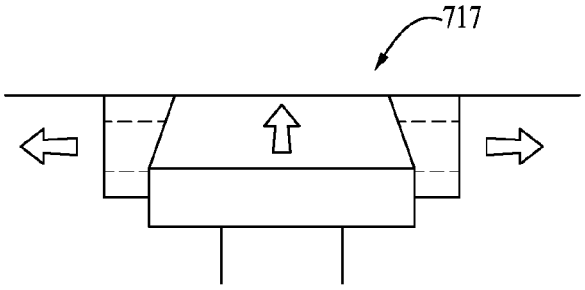
FIG. 38 is a top view of the pacifier and toy of FIG. 37 being attached together.

FIGS. 37-38 show a combination pacifier-toy device 710 according to an eighth example embodiment of the invention. This device 710 is similar to the embodiments described above in that it includes a pacifier 712, a toy (not shown), and a coupling 717 that removably attaches them together, but in this embodiment the coupling includes components that couple and decouple by an axial motion.

Figure 39:
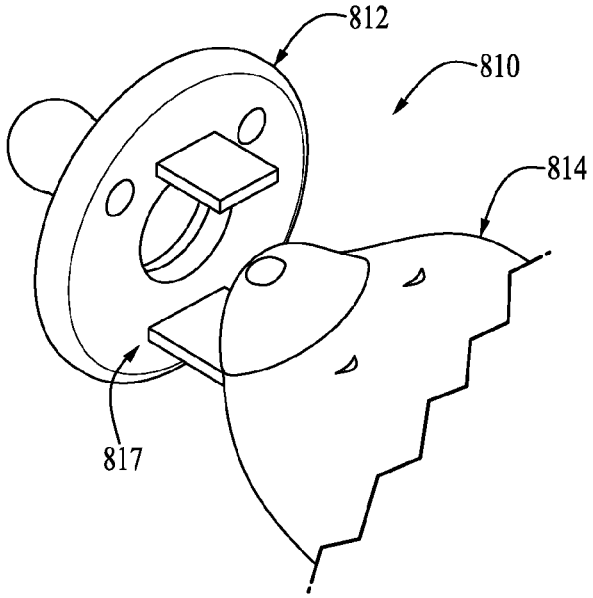
FIG. 39 is a top perspective view of a portion of a combination pacifier-toy device according to a ninth example embodiment of the present invention.
Figure 40:
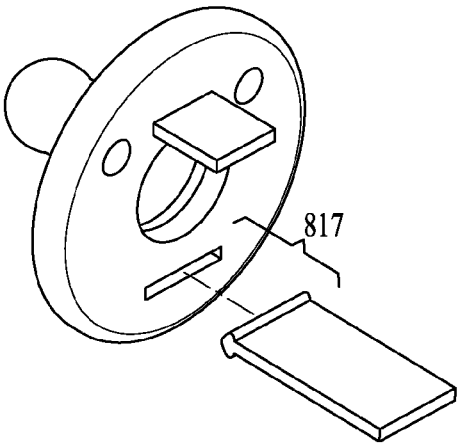
FIG. 40 shows the pacifier and toy of FIG. 39 detached from each other.

FIGS. 39-40 show a combination pacifier-toy device 810 according to a ninth example embodiment of the invention. This device 810 is similar to the embodiments described above in that it includes a pacifier 812, a toy 814, and a coupling 817 that removably attaches them together, but in this embodiment the coupling includes components that couple and decouple by an axial motion.

Figure 41:
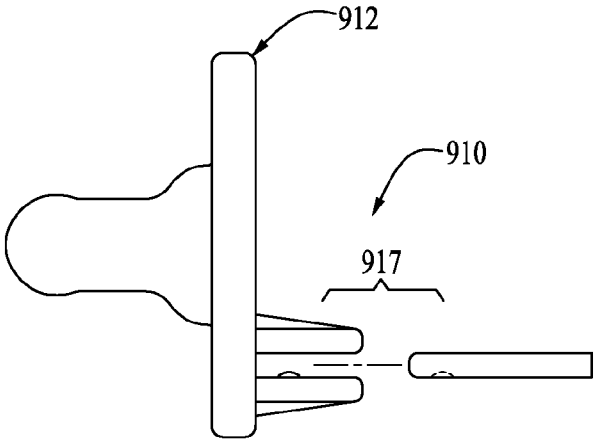
FIG. 41 is a side view of a portion of a combination pacifier-toy device according to a tenth example embodiment of the present invention, with the pacifier and toy detached from each other.
Figure 42:
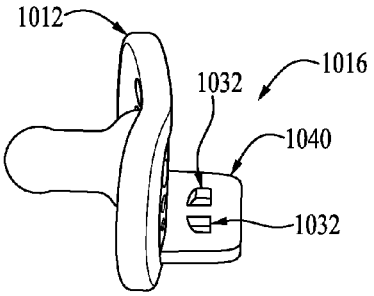
FIG. 42 is a perspective view of a pacifier portion of a combination pacifier-toy device according to an eleventh example embodiment of the invention.
Figure 43:
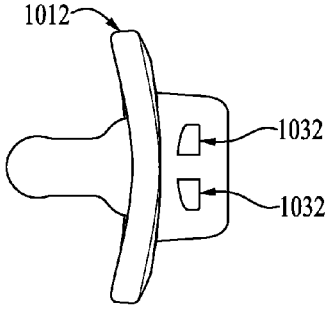
FIG. 43 is a top view of the pacifier portion of FIG. 42.
Figure 44:
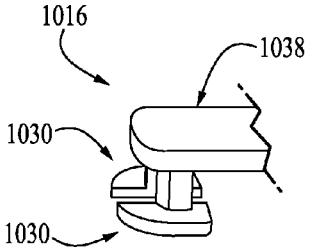
FIG. 44 is a perspective view of a toy portion of the combination pacifier-toy device of FIG. 42.
Figure 45:
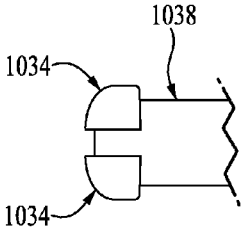
FIG. 45 is a bottom view of the toy portion of FIG. 44.
Figure 46:
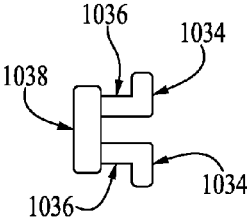
FIG. 46 is an end view of the toy portion of FIG. 45.
Figure 47:
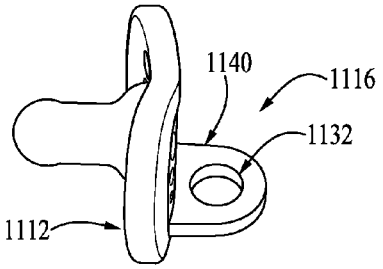
FIG. 47 is a perspective view of a pacifier portion of a combination pacifier-toy device according to a twelfth example embodiment of the invention.
Figure 48:
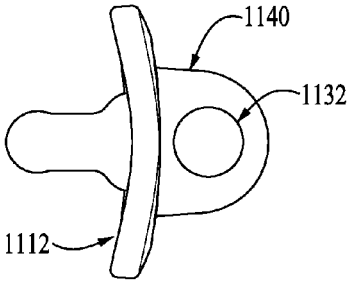
FIG. 48 is a top view of the pacifier portion of FIG. 47.
Figure 49:
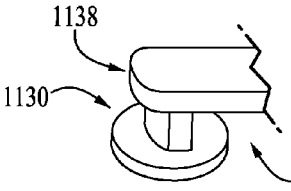
FIG. 49 is a perspective view of a toy portion of the combination pacifier-toy device of FIG. 47.
Figure 50:
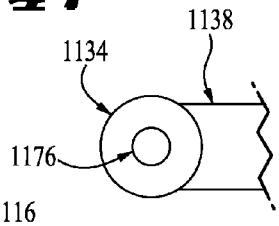
FIG. 50 is a bottom view of the toy portion of FIG. 49.
Figure 51:
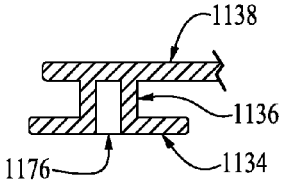
FIG. 51 is a side view of the toy portion of FIG. 45.
Figure 58:
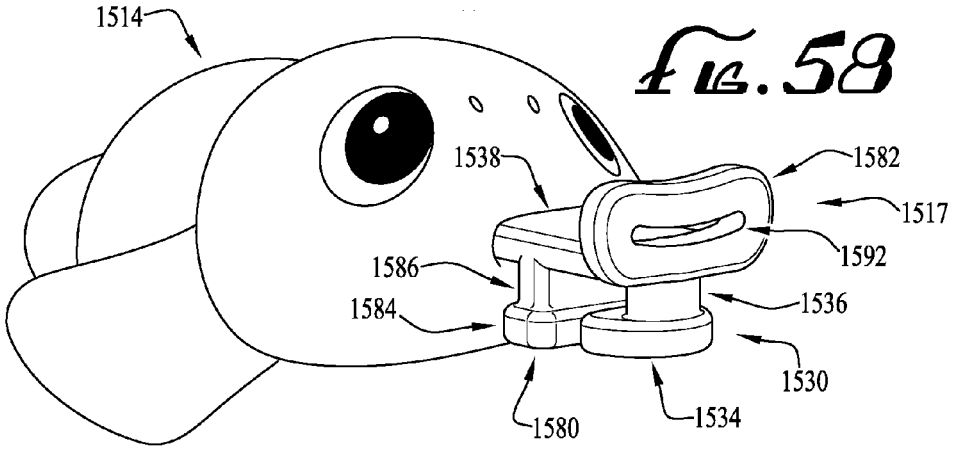
FIG. 58 is a perspective view of a toy with a multi-connector according to a sixteenth example embodiment of the invention.

FIG. 41 shows a combination pacifier-toy device 910 according to a tenth example embodiment of the invention. This device 910 is similar to the embodiments described above in that it includes a pacifier 912, a toy (not shown), and a coupling 917 that removably attaches them together, but in this embodiment the coupling includes components that couple and decouple by an axial motion.

FIGS. 42-46 show a portion of a combination pacifier-toy device according to an eleventh example embodiment of the invention. This device is similar to the first through sixth embodiments described above in that it includes a pacifier 1012, a toy (not shown), and a coupling 1016 that removably attaches them together, with the coupling including a transverse tab 1030 and a transverse opening 1032 that couple and decouple by a transverse motion. In this embodiment, there are two transverse tabs 1030 (each including a connecting arm 1036 with a retaining head 1036) extending transversely from the tab extension arm 1038, and two transverse openings 1032 formed transversely through the opening extension arm 1040. The connecting arms 1036, retaining heads 1036, and openings 1032 can be formed in a number of different shapes, for example quadrant (as depicted) or another regular or irregular shape.

FIGS. 47-51 show a portion of a combination pacifier-toy device according to a twelfth example embodiment of the invention. This device is similar to the first through sixth and eleventh embodiments described above in that it includes a pacifier 1112, a toy (not shown), and a coupling 1116 that removably attaches them together, with the coupling including a transverse tab 1130 and a transverse opening 1132 that couple and decouple by a transverse motion. In this embodiment, the connecting arm 1136 and the retaining head 1136 of the transverse tab 1130 (extending transversely from the tab extension arm 1138) have a circular cross-sectional shape, as does the transverse opening 1132 formed transversely through the opening extension arm 1140. In addition, the connecting arm 1136 and the retaining head 1136 of the transverse tab 1130 have a bore 1076 recessed therein such that an internal portion thereof is hollow and thus compressible (radial inward) to resiliently deform during insertion and withdrawal relative to the transverse opening 1132. The connecting arms 1136, retaining heads 1136, bores 1176, and openings 1132 can be formed in a number of different shapes, for example circular (as depicted) or another regular or irregular shape.

FIGS. 52-53 show a portion of a combination pacifier-toy device according to a thirteenth example embodiment of the invention. This device is similar to the first through sixth and eleventh through twelfth embodiments described above in that it includes a pacifier (not shown), a toy (not shown), and a coupling 1216 that removably attaches them together, with the coupling including a transverse tab 1230 and a transverse opening 1232 that couple and decouple by a transverse motion. In this embodiment, the connecting arm 1236, retaining head 1236, and opening 1232 are elliptical in shape.

FIGS. 54-55 show a portion of a combination pacifier-toy device according to a fourteenth example embodiment of the invention. This device is similar to the first through sixth and eleventh through thirteenth embodiments described above in that it includes a pacifier (not shown), a toy (not shown), and a coupling 1316 that removably attaches them together, with the coupling including a transverse tab 1330 and a transverse opening 1332 that couple and decouple by a transverse motion. In this embodiment, the connecting arm 1336, retaining head 1336, and opening 1332 are hexagonal in shape.

FIGS. 56-57 show a portion of a combination pacifier-toy device according to a fifteenth example embodiment of the invention. This device is similar to the first through sixth and eleventh through fourteenth embodiments described above in that it includes a pacifier (not shown), a toy (not shown), and a coupling 1416 that removably attaches them together, with the coupling including a transverse tab 1430 and a transverse opening 1432 that couple and decouple by a transverse motion. In this embodiment, the connecting arm 1436, retaining head 1436, and opening 1432 are triangular in shape.

FIGS. 58-61 show a toy 1514 with a multi-connector 1517 according to a sixteenth example embodiment of the invention. This toy 1514 is similar to at least the first embodiment described above in that it includes a toy part (e.g., a body and a head) and a coupling part (multi-connector 1517) that extends from the toy part and removably attaches to a cooperating coupling part of a soothing device (not shown). For example, the multi-connector 1517 can include a transverse tab 1530 that couples to and decouples from a transverse opening of the soothing device by a transverse motion. In this embodiment, the multi-connector 1517 includes an axial extension arm 1538 that extends axially from the toy 1514, and the transverse tab 1530 includes a retaining head 1534 and a connecting arm 1536 extending transversely between the axial extension arm and the retaining head. In this way, the transverse tab 1530 of the multi-connection assembly 1517 is the same as, or at least substantially similar to, that of the first embodiment described above. As such, additional details of the design and construction of these elements are not described for brevity.

In this embodiment, the multi-connector 1517 additionally includes one or more additional coupling elements that enable detachable coupling to a variety of different styles of coupling parts of soothing devices to provide greater versatility of use. For example, the multi-connector 1517 can additionally include a second generally parallel transverse tab 1580 extending from the same side 1537 of the axial extension arm 1538, a third slotted transverse tab 1582 extending from the opposite side 1539 of the axial arm, or both.

The depicted second tab 1580 of the multi-connector 1517, which extends transversely from the axial extension arm 1538 on the same side 1537 as the first transverse tab 1530, is positioned proximal of the first transverse tab, between the first tab and the body of the toy 1514. The second transverse tab 1580 can include, for example, a retaining head 1584 and a transverse connecting arm 1586 extending between the retaining head and the axial extension arm 1538. Thus, the second transverse tab can be similar in design and construction to the first transverse tab 1530. In particular, the first transverse tab 1530, the second transverse tab 1580, or typically both, in their entireties or at least substantial portions thereof, are made of a resiliently deformable material that permits the tabs to deform during coupling to and decoupling from the soothing device and also to resiliently return to a neutral at-rest state/position when coupled to the soothing device or separated from it.

Figure 59:
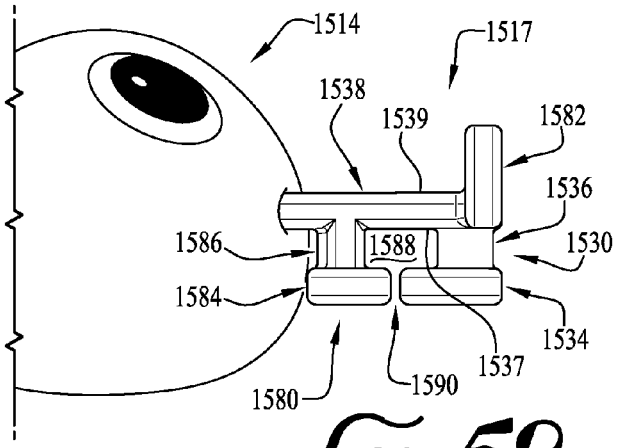
FIG. 59 is a side view of a proximal portion of the toy of FIG. 58 showing details of the multi-connector.
Figure 60:
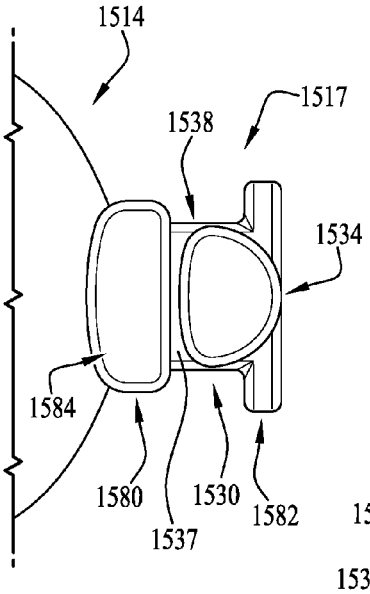
FIG. 60 is a bottom view of the toy proximal portion of FIG. 59.

Referring particularly to FIG. 59, the transverse connecting arm 1586 of the second transverse tab 1580 can be arranged generally parallel to the connecting arm 1536 of the first transverse tab 1530, as depicted. And the retaining head 1584 (or at least a portion thereof) of the second transverse tab 1580 can be generally axially aligned with the retaining head 1534 of the first transverse tab 1530, as depicted. The retaining heads 1534 and 1584 are positioned more closely together than the connecting arms 1536 and 1586, for example the retaining heads can be touching or immediately adjacent each other, and the connecting arms can be spaced apart sufficiently to receive a proximal lip or flange coupling part of a soothing device. In this way, the first and second connecting arms 1536 and 1586 and retaining heads 1534 and 1584 cooperate with the extension side 1537 of the axial extension arm 1538 to define a capture space 1588, and the retaining heads cooperate with each other to define an access opening 1590 extending between the capture space and the exterior of the multi-connector 1517.

In addition, the retaining head 1584 of the second transverse tab 1580 can be larger (e.g., in a plan-view profile) than the retaining head 1534 of the first transverse tab 1530, for example as depicted (see FIG. 60), to assist in retaining some coupling components of soothing devices. In other embodiments, the retaining heads have different sizes and/or shapes, or the same size and shape but different relative positions, selected for engagement with at least two different styles of coupling parts of soothing devices.

The depicted third tab 1582 of the multi-connector 1517, which extends transversely from the axial extension arm 1538 on the opposite side 1539 from the first transverse tab 1530, is positioned at the free/distal end portion of the extension arm, either at the absolute end (as depicted) or just proximally therefrom. The third transverse tab 1582 includes a slot 1592 formed in a transverse arm 1594 that extends from the axial extension arm 1538. The third transverse tab 1582, in its entirety or at least a substantial portion thereof (e.g., the inner/annular surface defining the slot 1592), is made of a resiliently deformable material that permits the tab (at least a portion immediately adjacent or surrounding the slot) to deform during coupling to and decoupling from the soothing device and also to resiliently return to a neutral at-rest state/position when coupled to the soothing device or separated from it.

Figure 61:
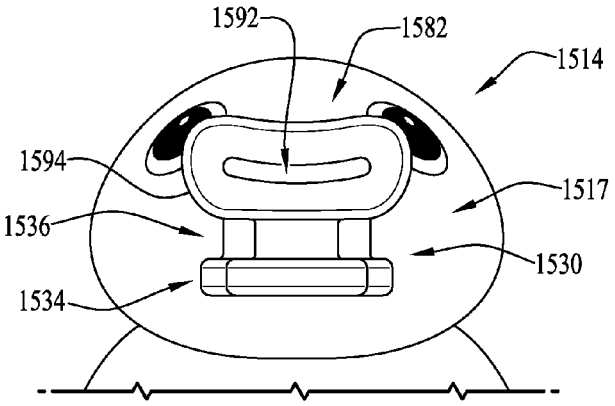
FIG. 61 is a front end view of the toy proximal portion of FIG. 59.

Referring particularly to FIG. 61, the slot 1592 of the third transverse tab 1582 can have an orientation (e.g. generally horizontal), shape, and size selected for receiving and frictionally retaining therein a coupling part of a soothing device. The slot 1592 can be defined axially through and enclosed/surrounded by the transverse arm 1594, as depicted, or it can be in the form of a notch or recess (axially or transversely recessed) with retaining features. In addition, the transverse arm 1594 has a width that is large enough for the slot 1592 to be formed in it, and as such it can be wider (e.g., in an end-view profile) than the extension arm 1538, for example as depicted (see FIG. 60).

In other embodiments, the transverse arm of the third transverse tab can have a width selected for being received and frictionally retained in an alternative coupling part of a soothing device, for example the transverse arm can have a retaining head portion at its free end and a connecting portion extending between the retaining head portion and the axial extension arm, with the retaining head portion being wider/larger than the connecting portion, so that an opening of the soothing device can slip over and be retained on the third transverse tab in an additional connection mode. And in other embodiments, the third transverse tab can include, in addition to frictional retention in the slot, a positive mechanical retaining element (e.g., a detent) to assist in retaining a protrusion of the soothing device in the slot.

FIGS. 62-64 show the toy 1514 removably attached to the pacifier 1512 of the first example embodiment. The pacifier 1512 includes an axial extension arm 1540 defining a transverse opening 1532 (for ease of gripping/holding by a child or caretaker). In this connection mode, the first transverse tab 1530 connects to the transverse opening 1532 of the pacifier 1512 by a transverse motion in the same way as described and shown above with respect to FIGS. 1-18. In this embodiment, however, the proximal lip/flange 1533 (the portion of the axial extension arm 1540 extending outward of the opening 1532) of the pacifier 1512 is received in the capture space 1588 of the multi-connector 1517 of the toy 1514. The lip/flanged portion 1533 being situated within the capture space 1588 helps to maintain attachment of the pacifier 1512 to the toy 1514. And the lip/flanged portion 1533 can be inserted into and removed from the capture space 1588 through the access opening 1590 because of the resiliently deformable nature of the first and second tabs 1530 and 1580 and/or of the axial extension arm 1540.

FIGS. 65-67 show the toy 1514 removably attached to a first alternative pacifier 1512*a* that is substantially similar to the pacifier 1512 just described. As such, in this connection mode the first transverse tab 1530 connects to the transverse opening 1532*a* of the transverse arm 1540*a* of the pacifier 1512*a* by a transverse motion in the same way as described and shown above, because this alternative pacifier has the same style of coupling parts even though this alternative pacifier is provided by a different manufacturer.

FIGS. 68-70 show the toy 1514 removably attached to a pacifier 1512*b* of a second alternative style. The pacifier 1512*b* includes a hinged ring 1540 defining a transverse opening 1532*b* (for ease of gripping/holding by a child or caretaker). In this connection mode, the first transverse tab 1530 connects to the transverse opening 1532*b* of the pacifier 1512*b* by a transverse motion, but not with a snug frictional fit (the tab is not snugly surrounded by the opening). However, the proximal lip/flange 1533*b* (the portion of the hinged ring 1540*b* extending outward of the opening 1532*b*) of the pacifier 1512*b* is received in the capture space 1588 of the multi-connector 1317 of the toy 1514. The lip/flanged portion 1533*b* being situated within the capture space 1588 helps to maintain attachment of the pacifier 1512*b* to the toy 1514. And the lip/flanged portion 1533*b* can be inserted into and removed from the capture space 1588 through the access opening 1590 because of the resiliently deformable nature of the first and second tabs 1530 and 1580 (and/or of the hinged ring 1540). In addition, the multi-connector 1517 can be shaped and sized based on the width and thickness of the lip/flanged portion 1533*b* for a snug fit within the capture space 1588.

Figure 71:
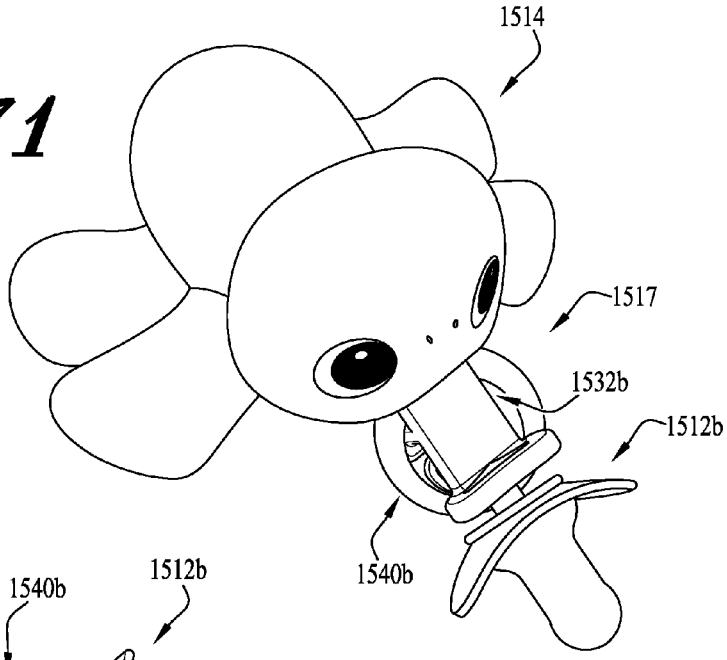
FIG. 71 is a perspective view of the toy of FIG. 58 shown removably attached in an alternative configuration to the second alternative style pacifier.
Figure 72:
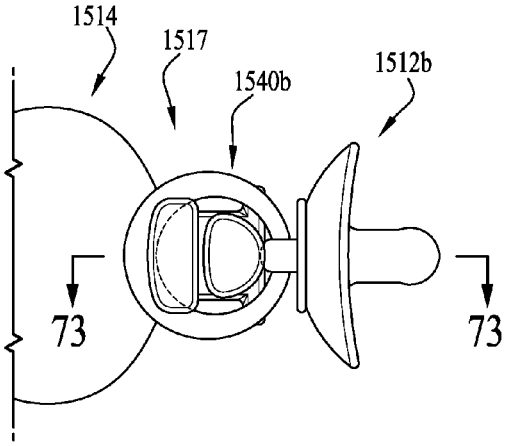
FIG. 72 is a bottom view of a proximal portion of the toy and the removably attached pacifier of FIG. 71.
Figure 73:
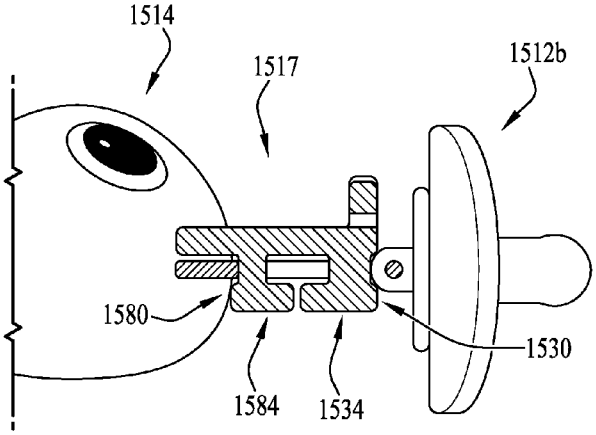
FIG. 73 is a cross-sectional view of the toy proximal portion and the removably attached pacifier taken at line 73-73 of FIG. 72.

FIGS. 71-73 show the toy 1514 removably attached in another connection mode to the second alternative style pacifier 1512*b*. In this connection mode, the hinged ring 1540*b* of the pacifier 1512*b* is positioned around both the first and second transverse tabs 1530 and 1580 with a snug frictional fit by a transverse motion, with the retaining heads 1534 and 1584 dimensioned larger than the transverse opening 1532*b* to help maintain the attachment of the pacifier 1512*b* to the toy 1514. As can be seen, this hinged-ring style pacifier 1512*b* can be removably attached to the multi-connector 1517 in at least two different connection modes, so that in the event a manufacturer has a less-than-ideal configuration for one of these connection modes, the other of these connection modes is still available to enable use of this style pacifier.

Figure 74:
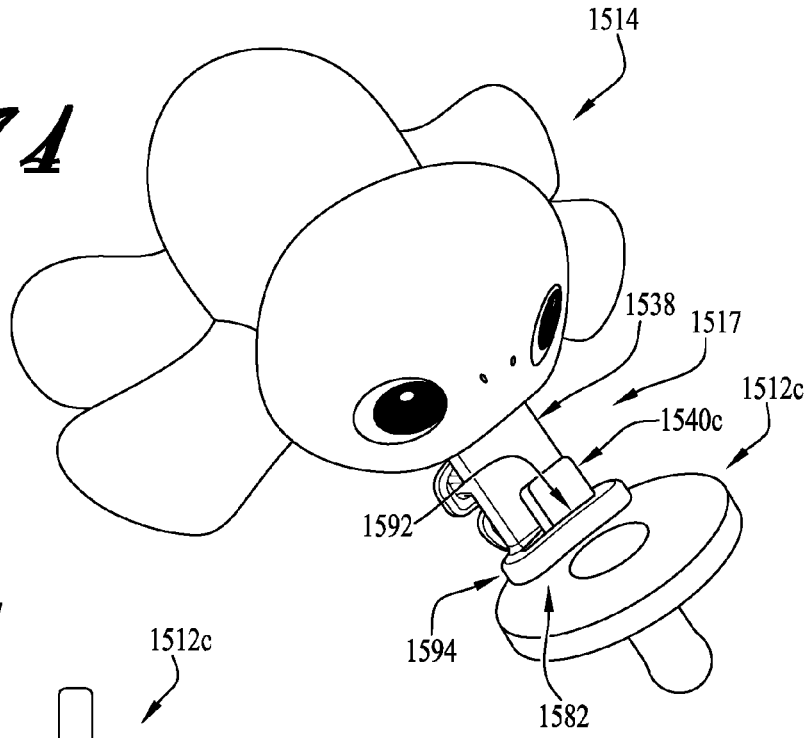
FIG. 74 is a perspective view of the toy of FIG. 58 shown removably attached to a third alternative style pacifier.
Figure 75:
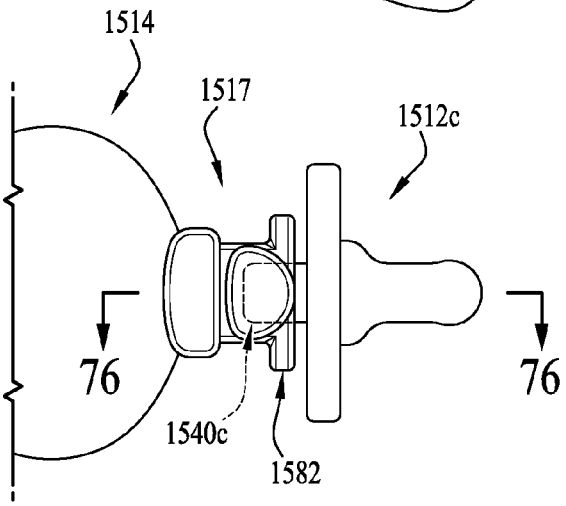
FIG. 75 is a bottom view of a proximal portion of the toy and the removably attached pacifier of FIG. 74.
Figure 76:
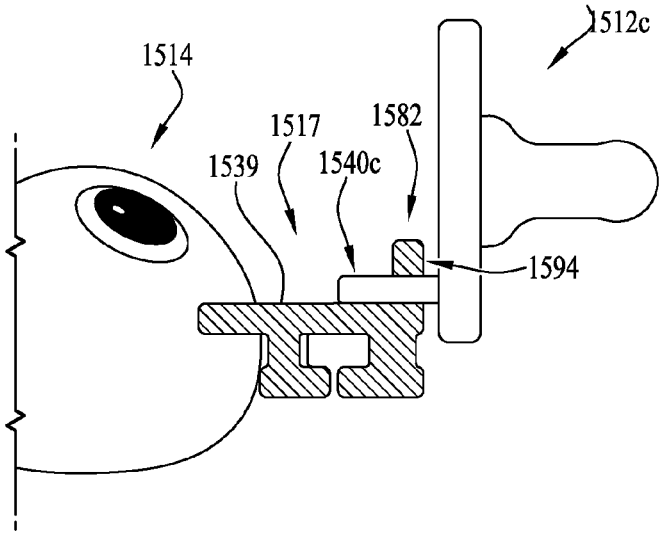
FIG. 76 is a cross-sectional view of the toy proximal portion and the removably attached pacifier taken at line 76-76 of FIG. 76.

FIGS. 74-76 show the toy 1514 removably attached to a pacifier 1512*c* of a third alternative style. The pacifier 1512*c* includes an axial extension arm 1540*c* that, in this connection mode, inserts into and is frictionally retained within the axial slot 1592 of the third transverse tab 1582 of the multi-connector 1517. The third transverse tab 1582 can be positioned at the absolute free end of the axial extension arm 1538 so that substantially all of the length of the pacifier extension arm 1540*c* can be received by the slot 1592 to assist in holding the parts together. And the slot 1592 can be formed in the transverse arm 1594 adjacent the extension side 1539 of the axial extension arm 1538 so that the pacifier extension arm 1540*c* abuts and is frictionally restrained by the toy extension arm 1538 to assist in holding the parts together.

Having described various details of some example embodiments of the multi-connector 1517, additional alternatives and variations contemplated by the invention will now be described. In the depicted embodiment, the multi-connector 1517 includes all three transverse tabs 1530, 1580, and 1582 to enable use with at least three different styles of soothing devices (more specifically, at least three different styles of coupling parts of soothing devices, regardless of the particular type of soothing device). In other embodiments, the multi-connector includes one or more additional (i.e., fourth, fifth, etc.) coupling elements to enable use with additional different styles of coupling parts of soothing devices. In yet other embodiments, the multi-connector includes less than all three transverse tabs 1530, 1580, and 1582, for example, only one of the tabs, or only any two of the tabs in combination.

In addition, features of the three transverse tabs 1530, 1580, and 1582, can be combined into only one or two of these transverse tabs to form additional embodiments. For example, the third transverse tab can be eliminated and its slot included in the first (and/or) transverse tab, or the first transverse tab can be eliminated and its retaining head included on the third transverse tab.

It should be noted that the side 1537 of the axial extension arm 1538 that the first and second transverse tabs 1530 and 1580 extend from can be the lower side, with the upper side 1539 being where the third transverse tab 1582 extends from (as depicted), or vice versa. In other embodiments, instead of the transverse tabs extending from upper and lower sides of the axial extension arm, they extend transversely from its left and right (generally upright) sides.

In one aspect of the invention, the toy is provided in combination one or more of the soothing devices packaged together as a set. In another aspect of the invention, the toy is provided by itself for use with separately provided soothing devices. In this way, the toy can be used with one or more existing (or new) soothing devices so long as they have a compatible coupling part.

While the invention has been described with reference to preferred and example embodiments, it will be understood by those skilled in the art that a variety of modifications, additions and deletions are within the scope of the invention, as defined by the following claims.

What is claimed is:

1. A toy for detachably connecting to any of a variety of different styles of soothing devices each having a soothing-device coupling part, the toy comprising:

a toy part defining a longitudinal axis; and a multi-connector extending from the toy part and including a plurality of coupling parts arranged transverse to the toy longitudinal axis and configured for individually or collectively releasably attaching to each of the different coupling part styles of the smoothing devices;

wherein the multi-connector includes an extension arm extending axially from the toy part along the longitudinal axis, wherein the plurality of coupling parts of the multi-connector include at least one tab extending transversely from the axial extension arm, and wherein the at least one transverse tab couples to and decouples from at least one of the coupling part styles of the soothing devices by a transverse motion; and wherein the at least one tab comprises two transverse tabs spaced apart from each other to collectively define a capture space therebetween that receives and retains therein a portion of at least one of the coupling part styles of the soothing devices by a transverse motion, and wherein the two transverse tabs can be received within another portion of the same coupling part style by a transverse motion; and wherein the two transverse tabs each include a respective retaining head and a respective connecting arm extending between the respective retaining head and the toy axial extension arm, and wherein the connecting arms, the retaining heads, and the toy axial extension arm cooperatively define the capture space.

2. The toy of claim 1, wherein the connecting arms of the two transverse tabs are spaced apart farther than are the retaining heads of the two transverse tabs, and wherein the retaining heads cooperatively form an access opening in communication with the capture space through which the portion of the coupling part style can be moved.

3. The toy of claim 1, wherein at least portions of the retaining heads of the two transverse tabs are axially generally aligned with each other.

4. The toy of claim 1, wherein the at least one tab comprises two transverse tabs, with one of the transverse tabs extending from a first side of the toy axial extension arm and having a retaining head that engages and retains a portion of at least one of the coupling part styles of the soothing devices by a transverse motion, and with the other of the transverse tabs extending from a second opposite side of the toy axial extension arm and having a slot formed therein that engages and retains a different portion of at least one different one of the coupling part styles of the soothing devices.

5. The toy of claim 1, wherein the at least one tab has a slot formed therein that engages and retains a portion of at least one of the coupling part styles of the soothing devices.

6. The toy of claim 1, wherein the toy part is a plush animal character and the soothing device is a pacifier including a nipple extending along the longitudinal axis and a flange from which the nipple extends.

7. The toy of claim1, wherein the axial extension arm has a length of less than about 1-¼inches and has a durometer of about 5 Shore A to about 70 Shore A.

8. The toy of claim 7, wherein a net pull-away force required to axially separate the toy from the soothing device is about 0.1 lbs. to about 10.0 lbs.

9. A toy for detachably connecting to any of a variety of different styles of soothing devices each having a soothing-device coupling part, the toy comprising:

a toy part defining a longitudinal axis; and a multi-connector including an extension arm and first and second tabs extending from a first side of thereof, wherein the extension arm extends axially from the toy part along the longitudinal axis, and wherein the first and second tabs are transverse to the longitudinal axis, extend transversely from the axial extension arm, and individually or collectively releasably attach to each of the different coupling part styles of the smoothing devices;

wherein the first and second transverse tabs are spaced apart from each other to collectively define a capture space therebetween that receives and retains therein a portion of at least one of the coupling part styles of the soothing devices by a transverse motion, and wherein the first and second transverse tabs can be received within another portion of the same coupling part style by a transverse motion; and wherein the first and second transverse tabs each include a respective retaining head and a respective connecting arm extending between the respective retaining head and the axial extension arm, and wherein the connecting arms, the retaining heads, and the toy axial extension arm cooperatively define the capture space.

10. The toy of claim 9, wherein the connecting arms of the first and second transverse tabs are spaced apart farther than are the retaining heads of the first and second transverse tabs, and wherein the retaining heads cooperatively form an access opening in communication with the capture space through which the portion of the coupling part style can be moved.

11. The toy of claim 9, wherein at least portions of the retaining heads of the first and second transverse tabs are axially generally aligned with each other.

12. The toy of claim 9, wherein the multi-connector further comprises a third transverse tab extending from a second opposite side of the axial extension arm and having a slot formed therein that engages and retains a different portion of at least one different one of the coupling part styles of the soothing devices.

13. The toy of claim 9, wherein the toy part is a plush animal character and the soothing device is a pacifier including a nipple extending along the longitudinal axis and a flange from which the nipple extends.

14. The toy of claim 9, wherein the axial extension arm has a length of less than about 1-¼inches and has a durometer of about 5 Shore A to about 70 Shore A, and wherein a net pull-away force required to axially separate the toy part from the soothing device is about 0.1 lbs. to about 10.0 lbs.

* * * * *